US008434177B2

(12) United States Patent
Chaffee

(10) Patent No.: US 8,434,177 B2
(45) **Date of Patent: *May 7, 2013**

(54) CONFIGURABLE INFLATABLE SUPPORT DEVICES

(76) Inventor: Robert B. Chaffee, Portland, ME (US)

( * ) Notice: Subject to any disclaimer, the term of this patent is extended or adjusted under 35 U.S.C. 154(b) by 619 days.

This patent is subject to a terminal disclaimer.

(21) Appl. No.: 11/954,932

(22) Filed: Dec. 12, 2007

(65) Prior Publication Data

US 2009/0049617 A1 Feb. 26, 2009

Related U.S. Application Data

(62) Division of application No. 10/192,757, filed on Jul. 10, 2002, now Pat. No. 7,328, 472.

(60) Provisional application No. 60/304,274, filed on Jul. 10, 2001, provisional application No. 60/374,403, filed on Apr. 22, 2002.

(51) Int. Cl.
*A47C 27/08* (2006.01)

(52) U.S. Cl.
USPC ..... 5/655.3; 5/654

(58) Field of Classification Search ..... 5/706, 644, 5/654, 655.3
See application file for complete search history.

(56) References Cited

U.S. PATENT DOCUMENTS

| | | | |
|---|---|---|---|
| 388,037 | A | 8/1888 | Hargin |
| 633,968 | A | 9/1899 | Swartzwelder |
| 918,391 | A | 4/1909 | Taarud |
| 934,465 | A | 9/1909 | Rust |
| 1,282,980 | A | 10/1918 | Takach |
| 1,361,453 | A | 12/1920 | Frey |
| 1,576,211 | A | 3/1926 | O'Kane |
| 1,944,466 | A | 1/1934 | Rubin |
| 2,028,060 | A | 1/1936 | Gilbert |
| 2,369,736 | A | 2/1945 | Hurt |
| 2,372,218 | A | 3/1945 | Manson et al. |
| 2,415,150 | A | 2/1947 | Stein |
| 2,434,641 | A | 1/1948 | Burns |
| 2,549,597 | A | 4/1951 | Harris |
| 2,575,764 | A | 11/1951 | Morner |
| 2,604,641 | A | 7/1952 | Reed |
| D167,871 | S | 9/1952 | Vega |
| 2,614,272 | A | 10/1952 | Morner |
| 2,672,628 | A | 3/1954 | Spanel |

(Continued)

FOREIGN PATENT DOCUMENTS

| | | | |
|---|---|---|---|
| DE | 4000629 | A1 | 7/1990 |
| FR | 2721581 | A | 12/1995 |

(Continued)

OTHER PUBLICATIONS

International Search Report from PCT Application No. PCT/US02/21756, dated Apr. 9, 2002.

(Continued)

*Primary Examiner* — Robert G Santos
(74) *Attorney, Agent, or Firm* — Lando & Anastasi, LLP

(57) ABSTRACT

A configurable, adjustable inflatable device including one or more inflatable bladders and a shape-defining member that combines with the inflatable bladders such that an overall shape of the configurable inflatable device is at least partially controlled by the shape-defining member.

45 Claims, 18 Drawing Sheets

U.S. PATENT DOCUMENTS 2,741,780 A 4/1956 Kimbrig
2,823,668 A 2/1958 Van Court et al.
2,842,783 A 7/1958 Druck
2,853,720 A 9/1958 Friedlander
3,008,214 A 11/1961 Foster et al.
3,042,941 A 7/1962 Marcus
3,128,480 A 4/1964 Lineback
3,155,991 A 11/1964 Dunham
3,164,151 A 1/1965 Vere Nicoll
3,274,624 A 9/1966 Noerdinger
3,424,151 A 1/1969 Ericson
3,462,775 A 8/1969 Markwitz et al.
3,505,695 A 4/1970 Bishaf et al.
3,561,435 A 2/1971 Nicholson
D220,953 S 6/1971 Des Pres
3,610,235 A 10/1971 Sivash
3,653,084 A 4/1972 Hartman
3,772,717 A 11/1973 Yuen et al.
3,790,975 A 2/1974 Phillip et al.
3,798,686 A 3/1974 Gaiser
3,813,716 A 6/1974 Francis
3,829,918 A 8/1974 Stamberger
3,840,922 A 10/1974 Morrison et al.
3,864,766 A 2/1975 Prete, Jr.
3,877,092 A 4/1975 Gaiser
3,898,703 A 8/1975 Stamberger
3,899,797 A 8/1975 Gunst
4,025,974 A 5/1977 Lea et al.
4,091,482 A 5/1978 Malcolm
4,099,773 A 7/1978 Chang
4,149,285 A 4/1979 Stanton
4,168,063 A 9/1979 Rowland
4,169,295 A 10/1979 Darling
4,175,297 A 11/1979 Robbins et al.
D253,983 S 1/1980 McRight
4,266,298 A 5/1981 Graziano
4,300,759 A 11/1981 Caplan
4,317,244 A 3/1982 Balfour-Richie
4,348,779 A 9/1982 Leber
4,371,999 A 2/1983 Reid
4,382,306 A * 5/1983 Lickert ..... 5/710
4,405,129 A 9/1983 Stuckey
4,489,452 A * 12/1984 Lickert ..... 5/710
4,594,743 A 6/1986 Owen et al.
4,644,597 A 2/1987 Walker
4,768,247 A 9/1988 Beier
4,807,554 A 2/1989 Chi-Hung
4,829,614 A 5/1989 Harper et al.
4,862,533 A 9/1989 Adams
4,890,344 A 1/1990 Walker
4,896,389 A 1/1990 Chamberland
4,905,332 A 3/1990 Wang
4,964,183 A 10/1990 LaForce, Jr.
4,970,741 A 11/1990 Spina
4,977,633 A 12/1990 Chaffee
4,982,466 A 1/1991 Higgins et al.
4,986,738 A 1/1991 Kawasaki et al.
5,044,030 A 9/1991 Balaton
5,060,324 A 10/1991 Marinberg et al.
5,068,933 A 12/1991 Sexton
5,079,785 A 1/1992 Garcia
5,085,214 A 2/1992 Barrett
5,117,517 A 6/1992 Su
5,163,196 A 11/1992 Graebe et al.
D335,999 S 6/1993 Van Driessche
5,226,184 A 7/1993 Cheng
5,243,722 A 9/1993 Gusakov
5,267,363 A 12/1993 Chaffee
D343,980 S 2/1994 Torchia
5,288,286 A 2/1994 Davis
5,367,726 A 11/1994 Chaffee
5,423,094 A * 6/1995 Arsenault et al. ..... 5/655.3
5,450,858 A 9/1995 Zablotsky et al.
5,474,361 A 12/1995 Hwang et al.
5,493,742 A 2/1996 Klearman
5,598,593 A 2/1997 Wolfe
5,606,756 A 3/1997 Price
5,619,764 A 4/1997 Lopau
5,638,565 A 6/1997 Pekar
5,689,845 A 11/1997 Sobieralski
5,699,569 A 12/1997 Schwarz-Zohrer
D391,435 S 3/1998 Song et al.
5,839,139 A 11/1998 Fink
5,845,352 A 12/1998 Matsler et al.
D405,636 S 2/1999 Stewart
5,902,011 A 5/1999 Hand et al.
5,904,172 A 5/1999 Gifft et al.
5,947,563 A 9/1999 Klimenko
5,951,111 A 9/1999 Klimenko
D414,976 S 10/1999 Su et al.
5,960,495 A 10/1999 Hsu et al.
5,963,997 A 10/1999 Hagopian et al.
5,970,545 A 10/1999 Garman et al.
6,047,425 A 4/2000 Khazaal et al.
6,076,214 A 6/2000 Klimenko
6,102,759 A 8/2000 Klimenko
6,129,524 A 10/2000 Woollenweber et al.
6,131,219 A 10/2000 Roberts
6,148,461 A 11/2000 Cook et al.
6,152,530 A 11/2000 Hsu et al.
6,189,168 B1 2/2001 Graebe
6,206,654 B1 3/2001 Cassidy
D441,586 S 5/2001 Su
6,224,444 B1 5/2001 Klimenko
6,240,584 B1 6/2001 Perez et al.
D448,229 S 9/2001 Su et al.
6,283,056 B1 9/2001 Tchaikovsky
6,302,145 B1 10/2001 Ellis et al.
6,397,417 B1 6/2002 Switlik
6,439,264 B1 8/2002 Ellis et al.
6,446,289 B1 9/2002 Su et al.
D464,225 S 10/2002 Boso et al.
6,487,737 B1 12/2002 Futagami
6,543,073 B2 4/2003 Wu
6,568,011 B2 5/2003 Fisher et al.
6,701,559 B2 3/2004 Boso et al.
7,299,513 B1 * 11/2007 Barrett et al. ..... 5/654
7,328,472 B2 2/2008 Chaffee
7,475,440 B2 * 1/2009 Chaffee ..... 5/644
8,336,143 B2 * 12/2012 Lemmer ..... 5/710
2002/0050010 A1 5/2002 Shimada
2002/0116765 A1 8/2002 Smith et al.
2002/0184710 A1 12/2002 Chaffee
2002/0194678 A1 12/2002 Chung
2003/0028971 A1 2/2003 Chaffee
2003/0066489 A1 4/2003 Whitehill
2003/0192123 A1 10/2003 Chaffee
2003/0200611 A1 10/2003 Chaffee
2004/0107503 A1 6/2004 Tu
2004/0168256 A1 * 9/2004 Chaffee ..... 5/713
2006/0253991 A1 11/2006 McClintock
2009/0049617 A1 * 2/2009 Chaffee ..... 5/706
2009/0300846 A1 * 12/2009 Chaffee ..... 5/710
2012/0272456 A1 * 11/2012 Lemmer ..... 5/710

FOREIGN PATENT DOCUMENTS

GB 903 557 A 8/1962
GB 1 381 952 A 1/1975
GB 2 198 341 A 6/1988
WO WO 01/87121 11/2001
WO WO 03/093709 1/2003

OTHER PUBLICATIONS

International Search Report from PCT Application No. PCT/US03/37230.

European Search Report from Application No. 0611442.8-2313 dated Jul. 6, 2006.

* cited by examiner

CONFIGURABLE INFLATABLE SUPPORT DEVICES

CROSS REFERENCE TO RELATED APPLICATIONS

This application is a divisional application of co-pending U.S. patent application Ser. No. 10/192,757, filed on Jul. 10, 2002, entitled "Configurable Inflatable Support Devices" by Robert B. Chaffee, which is now allowed, and which claims priority under 35 U.S.C. §119(e) to U.S. Provisional Application No. 60/304,274 filed Jul. 10, 2001, and U.S. Provisional Application No. 60/374,403 filed Apr. 22, 2002, each of which are herein incorporated by reference in their entirety.

BACKGROUND

1. Field of the Invention

The present invention relates to support and/or comfort devices that include an inflatable bladder, and in particular to such devices that are adjustable and configurable.

2. Discussion of Related Art

One type of conventional inflatable device includes a plurality of seam-connected parallel tubes, each tube being an inflatable bladder, as illustrated in FIG. 1. This conventional inflatable device may be fabricated by sealing one layer of air-impervious film directly to another with a number of parallel seams 30, forming a plurality of parallel tubes 32. This type of structure, commonly used for inflatable rafts, is easily constructed and inexpensive, but has some limitations. In particular, this type of structure may often suffer from dimensional instability. As illustrated in FIG. 1, when inflated, the inflated tubes 32 are less wide than deflated tubes 34. Referring to FIGS. 2*a* and 2*b*, the conventional inflatable device is shown in a deflated condition. When empty of air the bladder is generally flat, having a length 36 and a width 38, as shown in FIGS. 2*a* and 2*b*. When inflated, the length and width of the bladder begin to shrink as the two layers of film separate. Referring to FIGS. 3*a* and 3*b*, it can be seen that the width 40 of the inflated bladder is significantly smaller than the width 38 of the empty bladder, while the change in length (36 to 41) of the bladder during inflation is negligible. Thus, the ratio of the length to the width of the device does not remain constant when the bladder is inflated. This dimensional instability of the conventional structures often limits the utility of the devices as cushions. The utility of the conventional structure as a cushioning surface is further limited by its irregular surface which provides uneven cushioning.

SUMMARY OF THE INVENTION

According to one embodiment, a configurable inflatable device comprises an inflatable bladder and a shape-defining membrane that combines with the inflatable bladder such that an overall shape of the configurable inflatable device is at least partially controlled by the shape-defining membrane, and wherein the overall shape of the configurable inflatable device is substantially different from an inflated shape of inflatable bladder alone. In one example, the shape-defining membrane may either attach to the inflatable bladder by means of fasteners, and may at least partially encompasses the inflatable bladder. In another example, the configurable inflatable device may include a covering layer that at least partially encompasses the inflatable bladder. In addition, the configurable inflatable device may include a self-sealing valve to allow for inflation and deflation of the inflatable bladder, and for adjustment of a level of inflation of the inflatable bladder.

In one example, the inflatable bladder may include two layers of film that are sealed at a perimeter and sealed internally at regular intervals by a plurality of internal seams. The plurality of internal seams may be substantially shorter than an overall length of the inflatable bladder in a direction of orientation of the plurality of internal seams. The membrane may further include a plurality of flexible strips that are attached to at least some of the plurality of internal seams. In another example, the membrane may includes a plurality of rigid bars. The membrane may be attached to at least some of the plurality of internal seams by attachment devices.

According to another embodiment of the configurable inflatable device, the inflatable bladder may have a first width when deflated, and the membrane may have a second width, wherein the second width is substantially smaller than the first width. The configurable inflatable device may further include a covering layer that at least partially surrounds the inflatable bladder. For example, the covering layer may include a plurality of bands that fit around the inflatable bladder. Alternatively, the covering layer may be attached to at least one of the inflatable bladder and the membrane, or may have an envelope structure and substantially completely surround the inflatable bladder. The covering layer may be quilted or padded, or may include a comfort-enhancing fabric. The covering layer may also include a mesh material. In yet another example, the covering layer may be attached to at least one side of the inflatable bladder.

In another example, the membrane may include an opening through which the inflatable bladder can be inserted into the membrane. For example, the membrane my include at least one opening forming a sleeve, and the inflatable bladder may be inserted within the sleeve. The membrane may also include a plurality of openings forming a plurality sleeves that are separated by a corresponding interconnecting portions of the membrane. The interconnecting portions of the membrane may each have a substantially same length, such that a spacing between each of the plurality of openings is substantially uniform. Alternatively, the membrane may be wrapped around the inflatable bladder.

According to another example, the configurable inflatable device may include a planar membrane and a covering layer that at least partially surrounds the at least one inflatable bladder, wherein the covering layer is attached to the planar membrane. The planar membrane may be, for example, substantially rectangular. The configurable inflatable device may further include a rigid member attached to the planar membrane. At least one of the covering layer and the planar membrane may also include attachment devices for attaching the covering layer to the planar membrane, wherein the attachment devices are also adapted for adjusting a length of the planar membrane.

According to another example, the configurable inflatable device may include a first inflatable bladder and a second inflatable bladder, wherein the first inflatable bladder is attached to a first end of the membrane and the second inflatable bladder is attached to a second, opposing end of the membrane. Each of the first and second inflatable bladders may be at least partially surrounded by respective covering layers, wherein the respective covering layers may be attached to the membrane. The configurable inflatable device may further include a third inflatable bladder attached to an additional membrane section, that may be attached to the membrane, for example, at approximately a longitudinal center of the membrane. The additional membrane section may be attached such that the third inflatable bladder is pivotable between the first end and the second opposing end of the membrane. In another example, the membrane may includes openings to allow insertion of a lateral stiffening member into the membrane.

The inflatable bladder may, for example, have a cylindrical shape when inflated. Alternatively, the inflatable bladder may be U-shaped.

According to another embodiment, an adjustable inflatable body-support structure may comprise an inflatable bladder having a self-sealing valve, and a membrane that partially surrounds the inflatable bladder. The membrane may have at least one fastener for securing the membrane in position with respect to the inflatable bladder, and the membrane may at least partially control an overall shape of the inflatable bladder when inflated, such that the overall shape of the configurable inflatable device is different from an inflated shape of inflatable bladder alone.

Another embodiment of a configurable inflatable device comprises an inflatable bladder, and at least one pair of fasteners including a first fastener and a second fastener, coupled to the at least one inflatable bladder, wherein the first fastener is adapted to mate with the second fastener to configure the inflatable bladder and provide a predetermined shape of the inflatable bladder when inflated. The configurable inflatable device may further include a covering layer that at least partially covers the inflatable bladder.

According to yet another embodiment, method for configuring an inflatable body-support structure comprises combining a shape-defining membrane with an inflatable bladder to select an overall shape of the inflatable bladder when inflated, and inflating the inflatable bladder by a predetermined amount to configure the inflatable body-support structure to the overall shape. The level of inflation may be controlled to adjust comfort and/or support provided by the configurable inflatable device. Furthermore, the configurable inflatable device may have different utility depending of the level of inflation.

In another embodiment, an adjustable configurable inflatable device comprises an inflatable bladder and a shape-defining member that combines with the inflatable bladder, such that a combination of the shape-defining member and the inflatable bladder provides the adjustable configurable inflatable device with an overall shape that is substantially different from a shape of the inflatable bladder alone.

BRIEF DESCRIPTION OF THE DRAWINGS

The foregoing and other advantages, features and objects of the invention will be apparent from the following non-limiting description of various embodiments and aspects thereof, taken with reference to the following figures. It is to be appreciated that like elements may be disclosed in different figures and may not be described in detail with reference to each figure, and may also be illustrated by the same or different reference numbers in different figures. In the figures.

DETAILED DESCRIPTION

Figure 1:
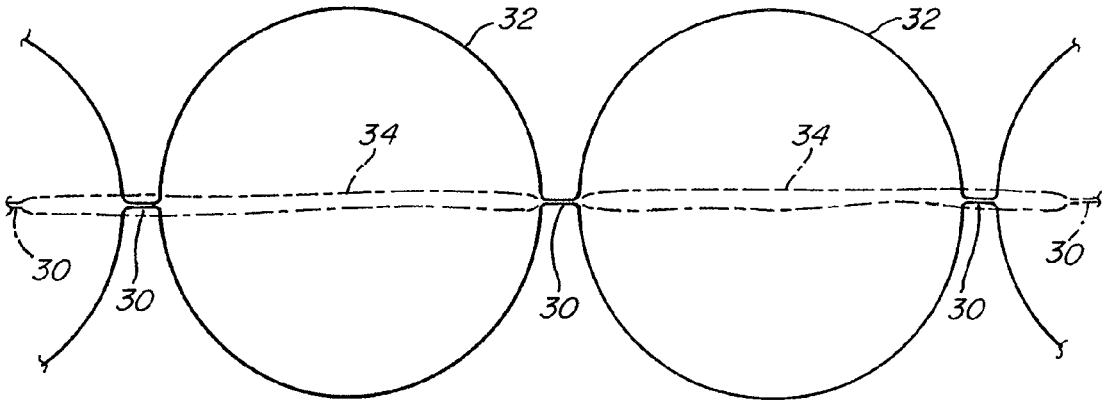
Fig. 1 (PRIOR ART)
FIG. 1 is a cross-sectional view of a conventional inflatable device.
Figure 2A:
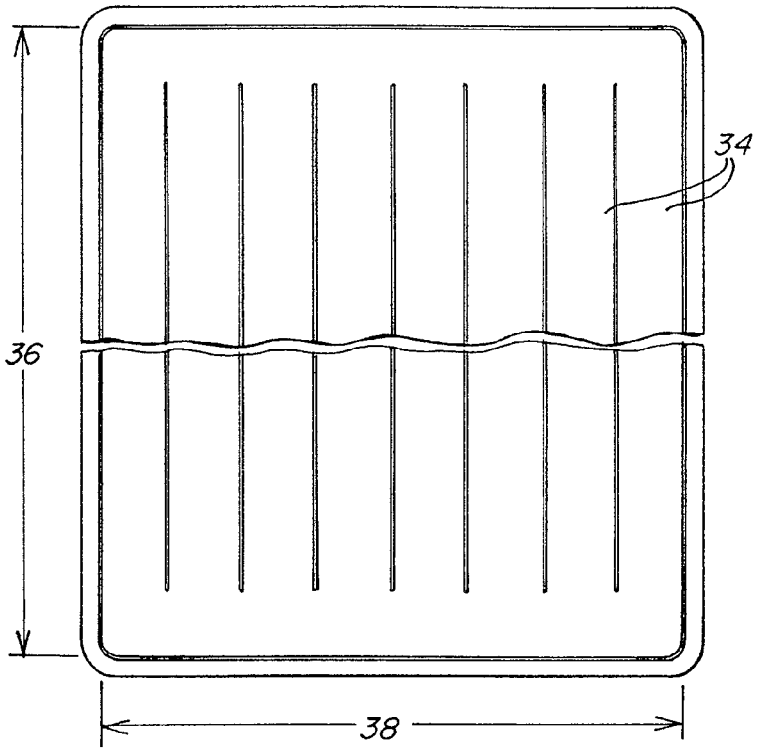
Fig. 2a (PRIOR ART)
FIG. 2*a* is a plan view of a conventional inflatable device when not inflated.
Figure 2B:
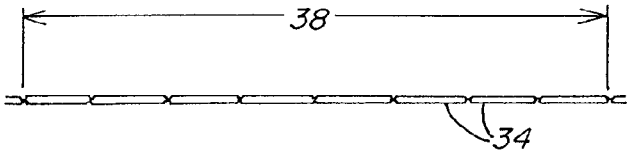
Fig. 2b (PRIOR ART)
FIG. 2*b* is a cross-sectional view of the conventional inflatable device of FIG. 2*a;*
Figure 3A:
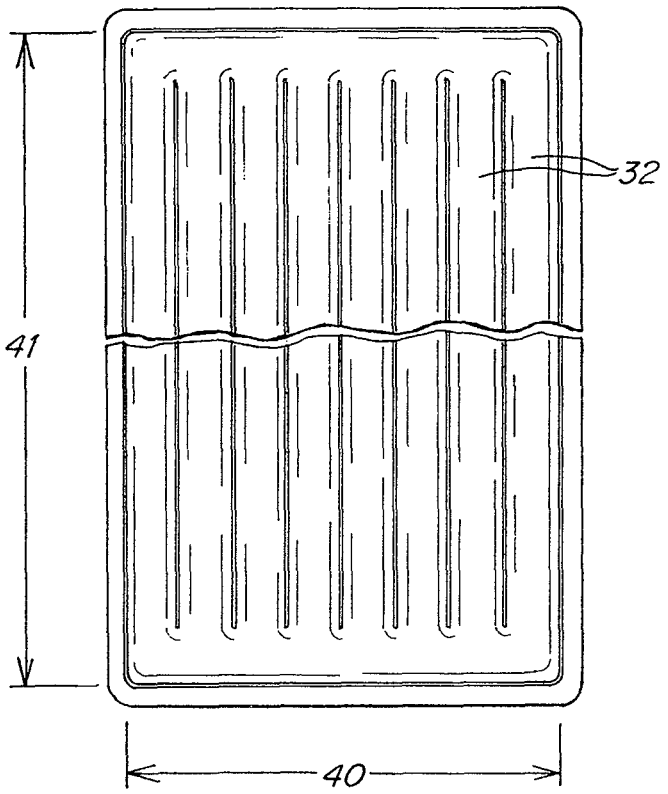
Fig. 3a (PRIOR ART)
FIG. 3*a* is a plan view of the conventional inflatable device of FIG. 2*a* when inflated.
Figure 3B:
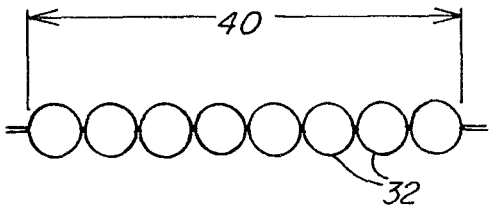
Fig. 3b (PRIOR ART)
FIG. 3*b* is a cross-sectional view of the conventional inflatable device of FIG. 3*a* when inflated.

Structures for inflatable support devices comprising rigid members, membranes and fasteners that may be combined in a variety of configurations to add utility to the basic structure of an inflatable bladder are disclosed herein. Also described are a variety of applications in which an inflatable bladder is used in combination with other members to provide support or comfort to persons or objects on land or in water. It is to be understood that the invention is not limited in its application to the details of construction and the arrangement of components set forth in the following description or illustrated in the drawings. Other embodiments and manners of carrying out the invention are possible. Also, it is to be understood that the phraseology and terminology used herein is for the purpose of description and should not be regarded as limiting. The use of "including," "comprising," or "having" and variations thereof is meant to encompass the items listed thereafter and equivalents thereof as well as additional items. Furthermore, the term "fluid" as used herein is meant to include all types of liquids and gases, for example, water or air, and other fluids, such as gels, that may be used to inflate the inflatable bladders of the invention. In addition, the term "planar" as used herein is meant to describe a structure, for example a membrane, that is substantially flat in one configuration, although it may not be completely flat and may have portions that protrude from the plane of the body of the structure, and may also have many other configurations in which it is not substantially flat.

Figure 4A:
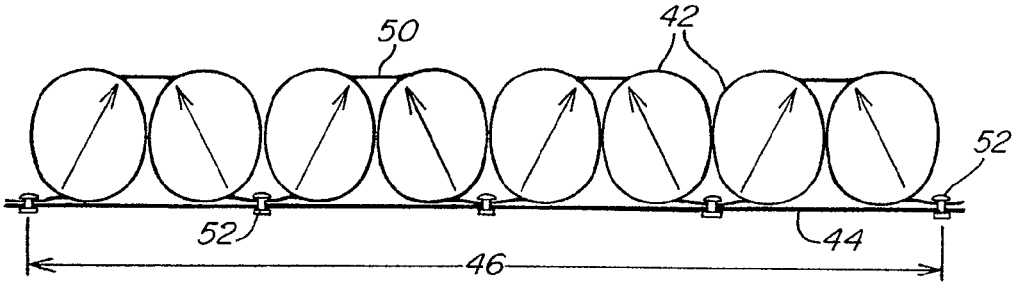
FIG. 4*a* is a cross-sectional view of an example of one embodiment of an inflatable device according to aspects of the invention.
Figure 4B:
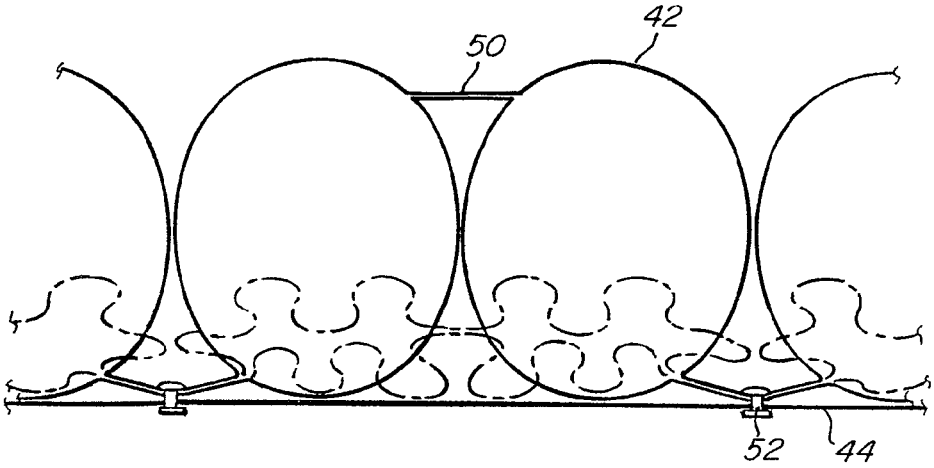
FIG. 4*b* is an enlarged view of a portion of the inflatable device of FIG. 4*a;*
Figure 4C:
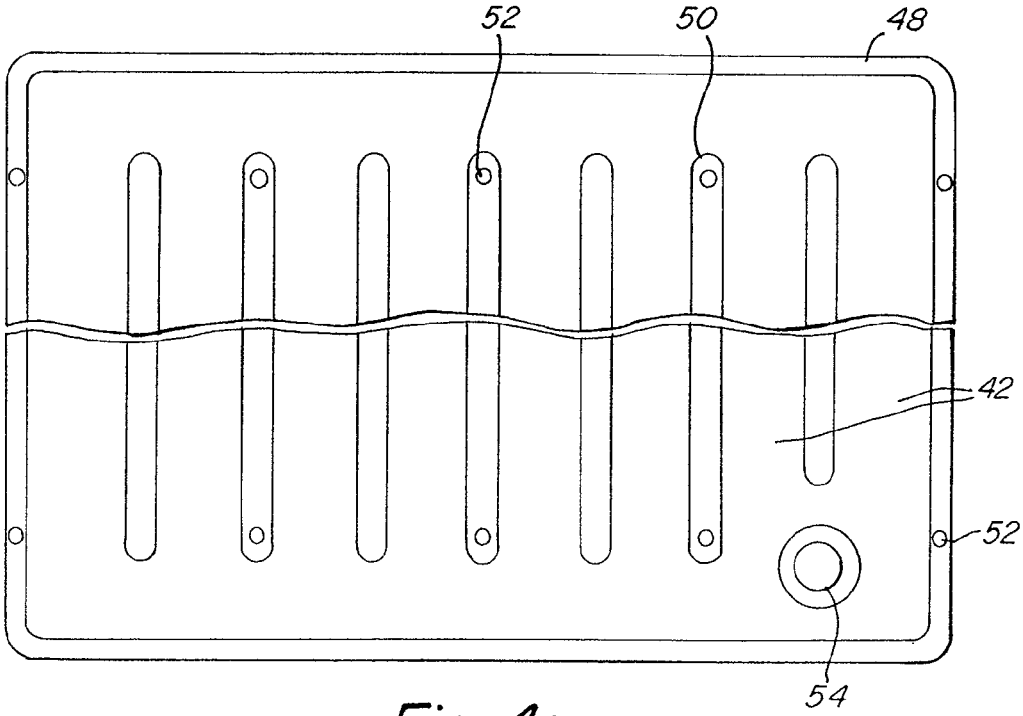
FIG. 4*c* is a plan view of the inflatable device of FIG. 4*a;*
Figure 5:
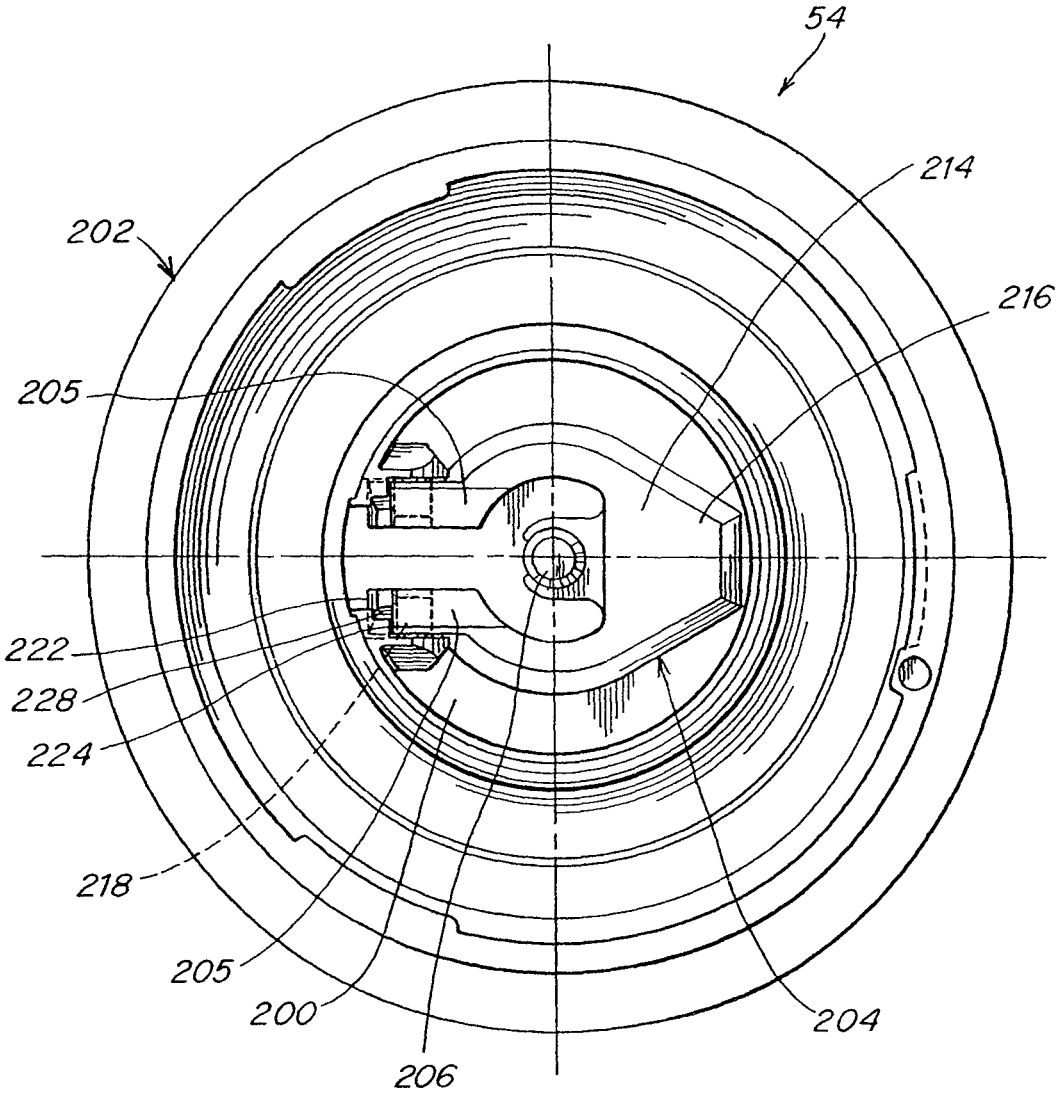
FIG. 5 is a top plan view of an example of a self-sealing valve that may be used with the inflatable bladders of the invention.
Figure 6:
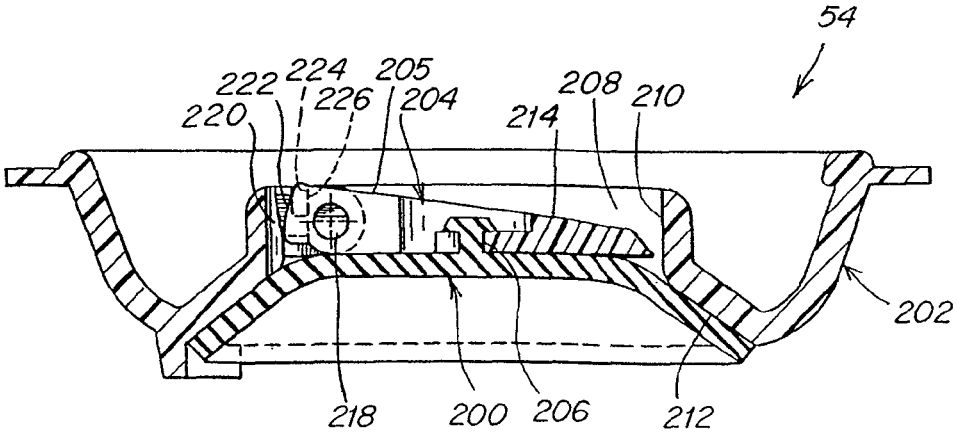
FIGS. 6-8 are cross-sectional views of the self-sealing valve of FIG. 5.
Figure 7:
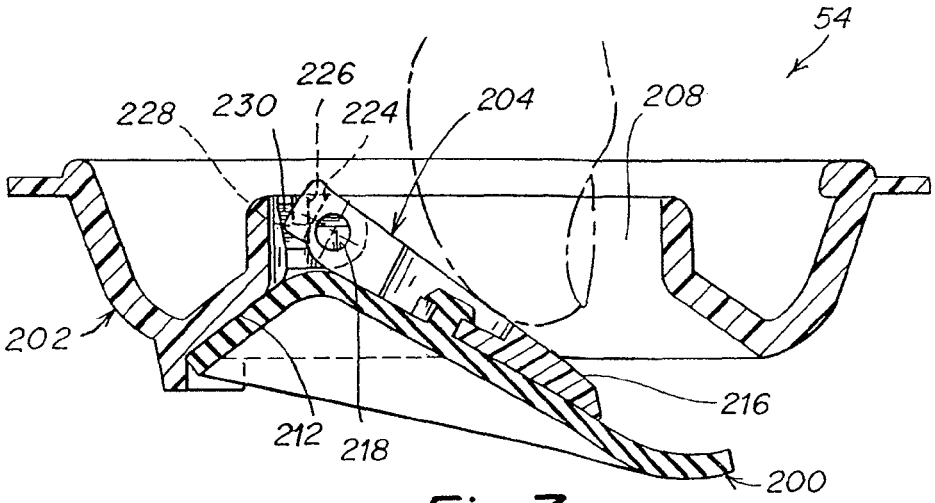
Figure 8:
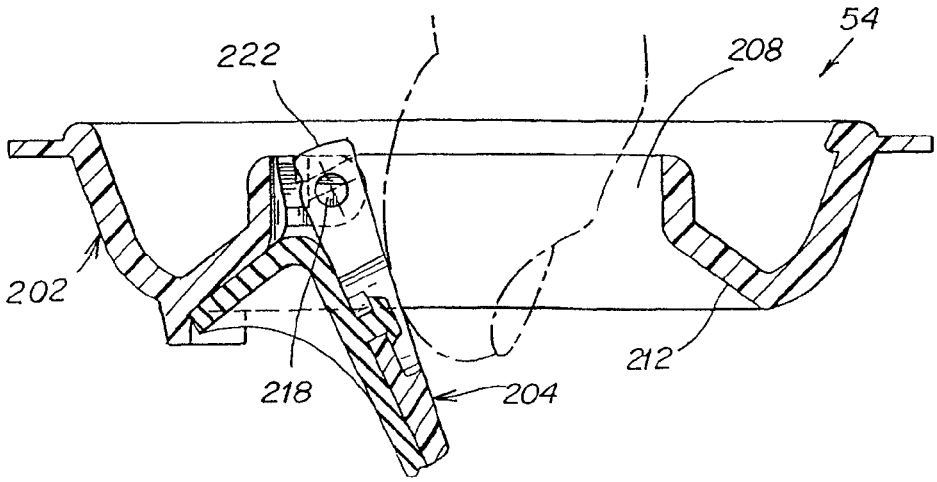

Referring to FIGS. 4*a-c*, there is illustrated an example of a parallel tube structure that overcomes the limitations of the prior art. According to one embodiment, an inflatable bladder may be provided in combination with a material that has a more stable length to width ratio. Such a combination may result in an inflatable device that does not contract or expand along a length to width axis upon inflation and deflation, and may additionally provide a more uniform and stable cushioning surface than prior art structures. Referring to FIG. 4*a*, a tube/mattress structure may include a plurality of interconnected tubes 42 attached to a membrane 44, which may be rigid or flexible, by means of attachment devices 52. According to one embodiment, the membrane may be a planar membrane. The planar membrane 44 may fix a width 46 of the tube/mattress structure at a value that may be somewhat less than its normal deflated width. In use, whether partially or fully inflated, attachment of the interconnected tubes 42 to the planar membrane 44 may add stability to the width dimension, predetermining the amount by which the width may expand or contract in accordance with the requirements of any particular application. In one example, the interconnected tubes 42 may be arranged substantially parallel to one another, as illustrated. However, it is to be appreciated that the interconnected tubes 42 may be arranged in a variety of other configurations.

According to one example, illustrated in FIGS. 4*a-c*, a tube/mattress structure may comprise one or more inflatable bladders formed from two layers of film, sealed at a perimeter 48 and sealed internally at regular, intervals by internal seams 50. Upon inflation, the bladders form tubes 42 of fluid having a generally circular cross-section, as illustrated. The internal seams 50 may be substantially shorter than an overall length of the bladder to allow generous fluid passage between chambers. In one example, the device may have alternate parallel seams 50, and may be attached to the planar membrane at controlled intervals by means of attachment devices 52. The inflatable bladder(s) may comprise a valve 54 that may be used to inflate and deflate the device. According to one example, the valve 54 may be a self-sealing valve, as will be described in more detail below. Upon inflation, the alternate seams 50 may force the bladders 42 to assume a compressed, corrugated configuration (zigzag end profile), as illustrated in FIG. 4*a*. This structure may improve surface resiliency, providing depth and uniformity of surface which may be unavailable with conventional parallel tube structures, and may be dimensionally stable, retaining the same length to width ratio whether inflated or deflated. Because it is dimensionally stable, the tube/mattress structure may be sized or shaped to accommodate a variety of applications which conventional parallel tube devices may not serve well due to their dimensional instability and irregular surface. The tube/mattress structure may further be provided with fasteners to enable it to be attached to a fixed surface such as, for example, a wall or chair, or any rigid member.

Referring to FIGS. 5-8, there is illustrated one embodiment of a self-sealing valve 54 that may be used with the tube structure described above. In this embodiment, a self-sealing valve 54 may include a diaphragm 200 positioned within a valve housing 202 by a movable hanger arm 204 which suspends the diaphragm from a mounting point 206 in the center of an air inlet 208. The hanger arm 204 is a rotating diaphragm hanger that is removably contained within the air inlet 208 of the valve housing 202, with one end secured adjacent to an inner wall 210 of the air inlet 208. A point of attachment of the one end of the hanger arm 204 to the inner wall 210 is configured to allow the hanger arm 204 to pivot downward into the valve housing 202, a motion which unseats the diaphragm 200 from a valve seat 212, in a closed position, and opens an airpath, to an open position, into the bladder of the surface comfort layer device to allow for both inflation and deflation of the inflatable bladders of the tube structure.

According to one example, the hanger arm 204 flares outward towards the inner wall 210 of the air inlet 208 creating a "paddle" surface 214 which overspreads much of the air inlet 208. The paddle surface 214 of the hanger arm 204 provides stability to the flexible diaphragm 200 as it rotates with the hanger arm 204 from the closed position to the open position. The expanded paddle surface 214 of the hanger arm 204 also enhances manipulation of the hanger arm 204 by, for example, a fingertip of a user to, for example, control a firmness of the inflatable bladder. The paddle surface 214 projects outward to a point 216, extending the length of the hanger arm 204. This projection bears upon the flexible diaphragm 200, thereby preventing it from flexing upward when the hanger arm 204 is pressed downward for firmness control or deflation.

The hanger arm 204 may be secured within the air inlet 208 with a pair of hinge pins 218. In one example, there is a contoured section 220 between the hinge pins 218 of the inner wall of at least one of the brackets and the inner wall 210 of the air inlet 208. The contoured section 220 interfaces with a contoured end 222 of projecting tabs 205 to provide a plurality of distinct interaction possibilities. A first possibility exists when surfaces 224 on the projecting tabs 205 bear on surfaces 226 of the inner wall, restricting rotation of the arm above a horizontal position, thereby securing the valve diaphragm in a substantially closed position.

A second possibility exists when a beveled surface 228 on the projecting tabs 205 bear on counter-beveled surfaces 230 on the wall. An inclined angle of these counter-beveled surfaces 230 cause the projecting tabs to increasingly compress inward as the hanger arm 204 is pressed downward into the valve housing 202. This may occur both during inflation (by air pressure) and deflation (by manual deflection of the hanger arm to unseat the valve from the valve seat). The compression of the projecting tabs also results in a counter action, so that, with removal of the downward pressure the tabs spring back to their original position and forces the hanger arm 204 and diaphragm 200 to return to the closed position. When the hanger arm 204 is depressed fully, the projecting tabs rotate slightly beyond the beveled surface 230 and lock the rotating arm in a locked open position. This locked open position maximizes airflow through the valve housing and will, under certain conditions improve efficiency of both inflation and deflation. These and other embodiments of the self-sealing valve 54 are described in more detail in U.S. Pat. No. 6,237,621, which is herein incorporated by reference.

It is to be appreciated that the tube/mattress structure may be further adjustable and configurable by controlling the degree of inflation of the inflatable bladders using the self-sealing valve 54. As discussed above, by manipulating the hanger arm of the valve, the firmness (degree of inflation) of the inflatable bladder may be controlled, which may in turn partially control the shape of the tube/mattress structure. The utility of the tube/mattress structure, and other embodiments of the invention, may vary depending on the level of inflation.

Figure 9:
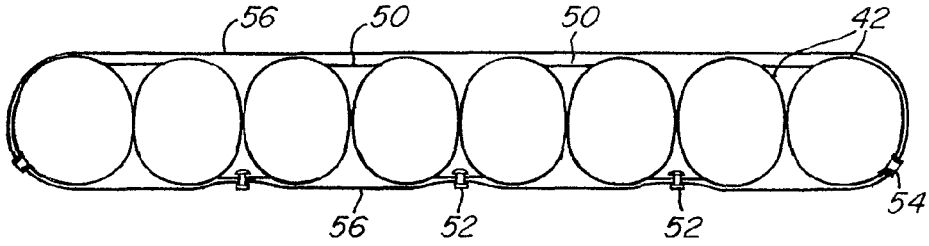
FIG. 9 is a cross-sectional view of one example of an inflatable device according to aspects of the invention.

For portable applications, or other applications where maximum collapsibility may be desirable, flexibility of the planar membrane 44 may be important. The planar membrane 44 does not have to be solid or closed. For example, referring to FIG. 9, which illustrates another example of a tube/mattress structure, a planar membrane may include a plurality of strips 56 of flexible material running perpendicular to the direction of the tubes 42. The strips 56 may be attached at alternative parallel seams 50 by means of attachment devices 52. Alternatively, instead of being made of a flexible material, the strips 56 may be, for example, tubes, rods, bars, etc., made of a rigid material, and may be combined with the inflatable bladder 42 to provide rigidity to the structure. According to another example, the tube/mattress structure may incorporate an attached planar membrane, as described above, on both opposing surfaces of the structure. This may add further rigidity and dimensional stability to the structure.

Figure 10A:
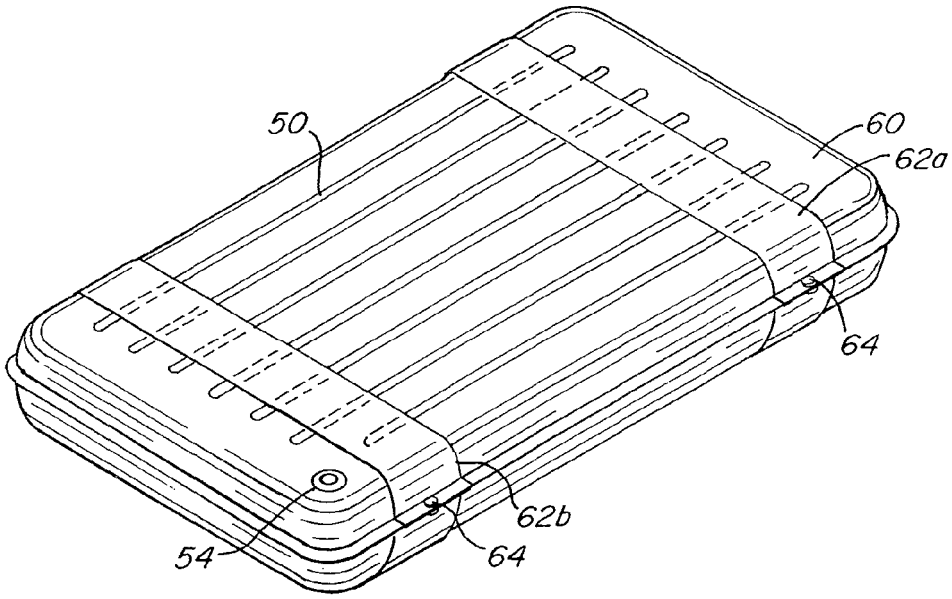
FIGS. 10*a-d* are perspective views of an inflatable device including examples of covering layers according to aspects of the invention.

According to another example, a tube/mattress structure 60, such as those described above, may be attached to an outer covering layer which may partially or completely surround the tube assembly. FIG. 10*a* illustrates one example of a covering layer comprising two bands 62*a* and 62*b* that may fit around the tube/mattress structure 60. In one example, the bands may be fastened around the tube/mattress structure 60 using fasteners 64, which may be, for example, hook and loop fasteners, such as Velcro® hook and loop fasteners, adjustable straps, buttons, snap fasteners, or another type of fastener. Alternatively, the bands 62*a* and 62*b* may be elasticized and may be sized so as to fit snugly about the tube/mattress structure 60. It is to be appreciated that although the illustrated example includes two bands 62*a* and 62*b*, a covering layer may be provided including any number of bands, for example three or four bands, possibly depending on a size of the structure or on a desired degree of firmness and/or comfort.

Figure 10B:
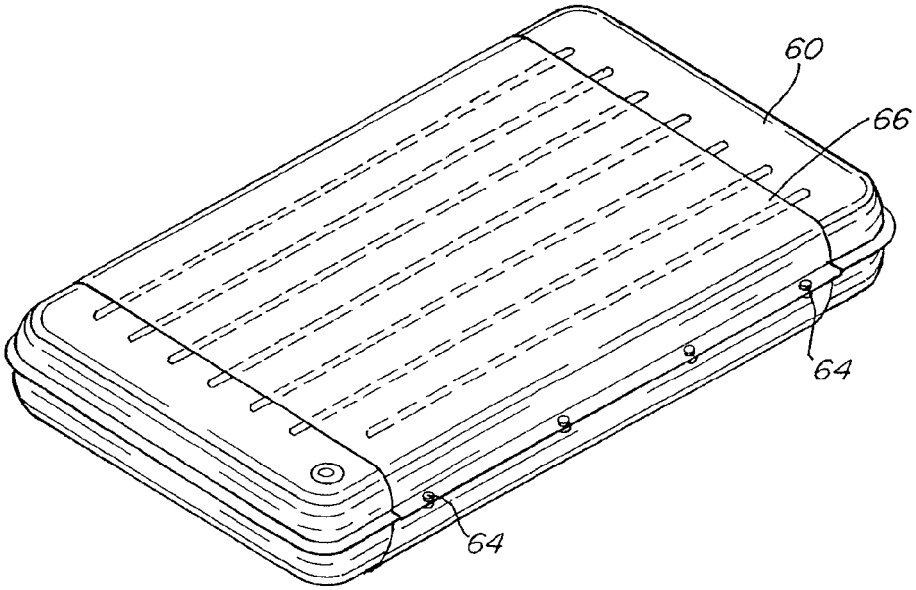
Figure 10C:
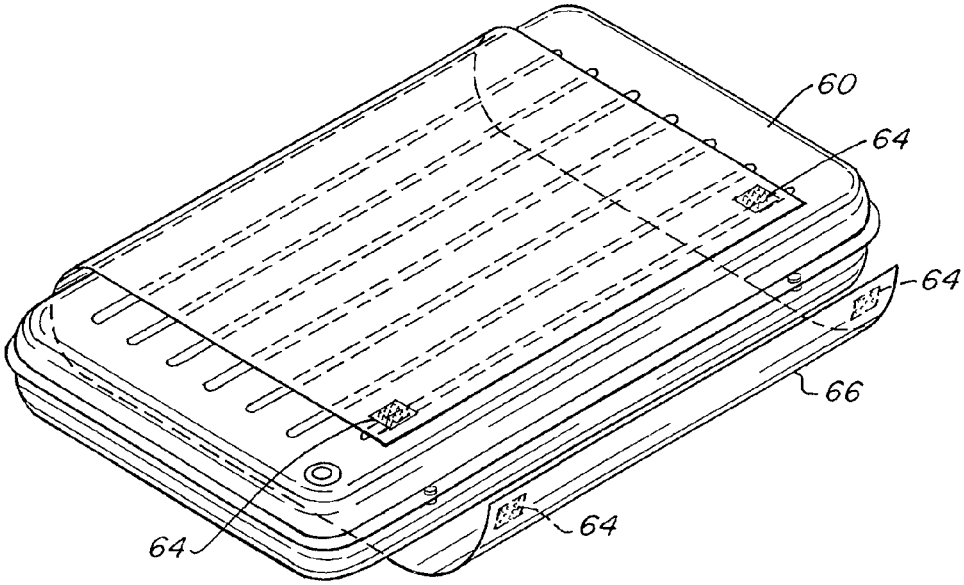
Figure 10D:
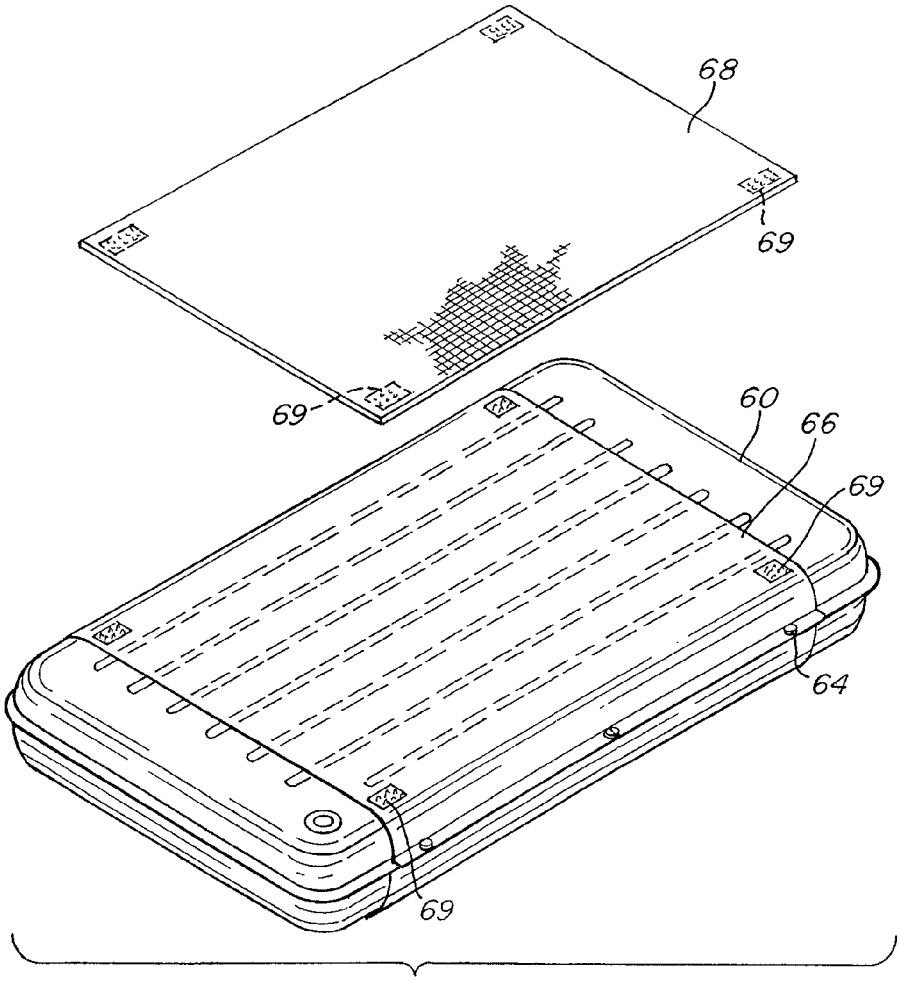

FIGS. 10*b-d* illustrate other examples of a covering layer 66 that may partially surround the tube/mattress structure 60 and may improve resiliency and performance of the structure. The covering layer 66 may be attached directly to the tube/mattress structure, or may wrap around the tube/mattress structure. In one example, the covering layer 66 may be attached by means of fasteners 64 to the tube/mattress structure such that the cover runs perpendicular to the direction of the tubes and parallel to the direction of the planar membrane. The cover may be a closed or an open covering, fully or partially surrounding the bladder. For example, the covering layer may have an envelope structure and may completely encompass the tube structure. The cover may also serve as a comfort layer and may be quilted and/or made from a comfort-enhancing fabric. As illustrated in FIGS. 10*b* and 10*c*, the covering layer 66 may be wrapped around the tube structure 60 and may be fastened with fasteners 64, which may be any of the types of fasteners discussed above with reference to FIG. 10*a*. For example, FIG. 10*b* illustrates button fasteners 64 and FIG. 10*c* illustrates the covering layer being fastened with hook and loop fastener tabs. The covering may offer several benefits such as restricting side-to-side motion of the tubes, or restricting excessive expansion of the tubes on the side opposing the attached planar membrane, thereby helping to maintain flatness of the structure at full or partial inflation. The covering layer may further provide a barrier surface that disperses both vertical and horizontal point loading, thus helping to distribute such loads throughout the structure and thereby providing more uniform surface resiliency. The covering layer may also serve to protect the inflatable bladder from punctures. According to one example, the covering layer may serve as the attached membrane described above.

Referring to FIG. 10*d*, an additional comfort layer 68 may be provided that may attach to the covering layer 66. The additional comfort layer 68 may be quilted, for example of polyester or cotton batting, may be made from another comfort-enhancing fabric, or may include a resilient synthetic material, such as, for example, latex or polyurethane foam. In one particular example, the additional comfort layer may include a polyurethane foam having a thickness of up to approximately four inches. The additional comfort layer 68 may to attach any or all of the covering layer 66, the inflatable bladder, and the membrane, by way of fasteners 69, which may be, for example, hook and loop fastener tabs as illustrated, or buttons, snap fasteners, or another type of fastener. An example of another type of fastener that may be used with the inflatable bladder and/or membrane is a button latch fastener described in U.S. patent application Ser. No. 09/862,858, filed on May 22, 2001 which is herein incorporated by reference in its entirety.

In yet another example, the additional comfort layer 68 may not be attached to the tube/mattress structure, but may be at least partially enclosed by the covering layer 66, and thereby held in position. In this example, the additional comfort layer is placed between the tube/mattress structure 60 and the covering layer 66. It is to be appreciated that where the terms "covering layer" and "membrane" apply, each may serve to protect the inflatable bladder and provide shape and stability to the overall structure, and may be substantially interchangeable in many applications. Each of the covering layer and membrane may further serve to add a comfort layer or surface to the inflatable device. It is further to be appreciated that the term "additional comfort layer" refers to a material layer that may further enhance the comfort provided by the inflatable device.

Figure 11A:
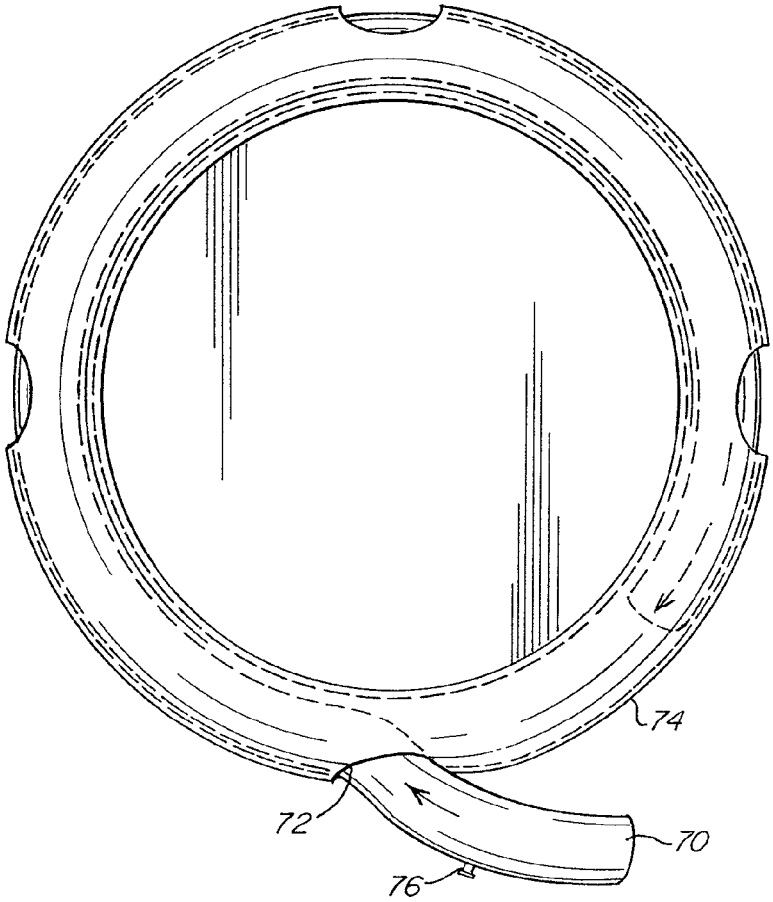
FIG. 11*a* is a plan view of an example of another embodiment of a configurable inflatable device according to aspects of the invention.
Figure 11B:
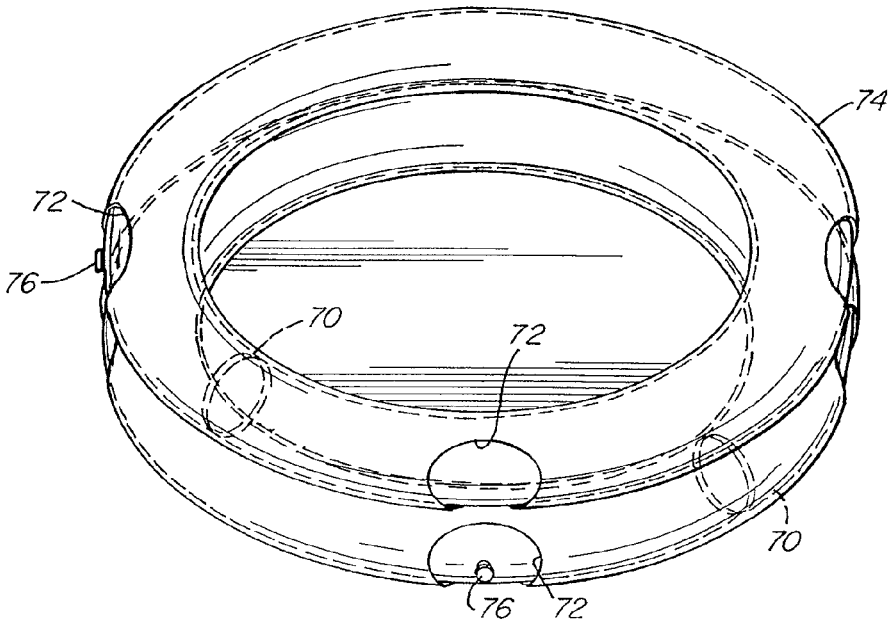
FIG. 11*b* is a perspective view of one example of the configurable inflatable device of FIG. 11*a;*

According to another embodiment, a configurable inflatable device may include one or more tube-shaped inflatable bladders that may be combined with a membrane, which may be a planar membrane. For example, there is illustrated in FIGS. 11*a* and 11*b*, an inflatable device that may be used to form a small pool. An inflatable bladder 70 may be provided that may form a tube when inflated. The inflatable bladder 70 may be inserted, via a hole 72, into a membrane 74, as illustrated in FIG. 11*a*. The inflatable bladder may be inserted prior to or after inflation. The inflatable bladder 74 includes a valve 76 for inflation and deflation. The valve 76 may be, for example, the self-sealing valve discussed above. When the inflatable bladder is contained within the membrane 74, the diameter of the inflated tube provides depth to the structure and a small pool may be formed. The membrane 74 provides the body of the pool while the tube provides support for the walls. The membrane 74 constrains the inflatable tube, preventing it from assuming its normal, generally straight cylindrical shape. Thus, the combination of one or more inflatable bladders and the membrane provides a configurable inflatable device that may be formed into shapes and structures that are different from the shape or structure that the inflatable bladder would naturally assume upon inflation.

Referring to FIG. 11*b*, the membrane 74 may be constructed such that two or more inflatable tubes may be inserted therein. As shown in FIG. 11*b*, the depth of the pool may be increased by providing two or more openings 72 in the membrane so that two or more inflatable tubes may be inserted, one on top of another. It is intended that the pool described herein serve as an illustrative example of a more general inflatable structure that includes one or more inflatable bladders constrained by a membrane.

Figure 12A:
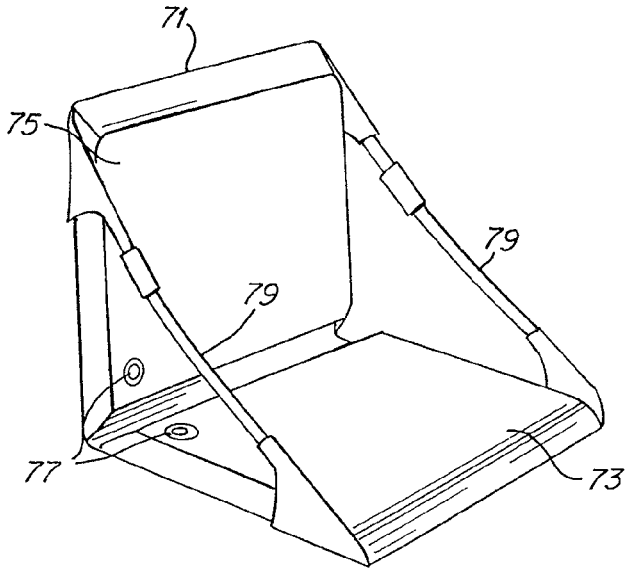
FIG. 12*a* is a perspective view of another embodiment of a configurable inflatable device according to aspects of the invention.
Figure 12B:
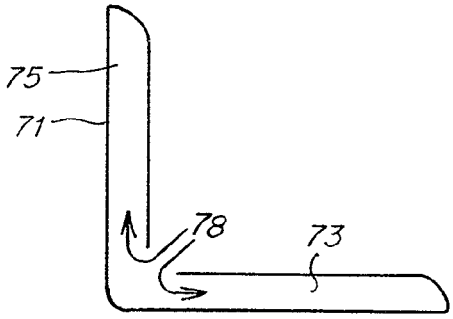
FIG. 12*b* is a sectional side view of the configurable inflatable device of FIG. 12*b,*
Figure 12C:
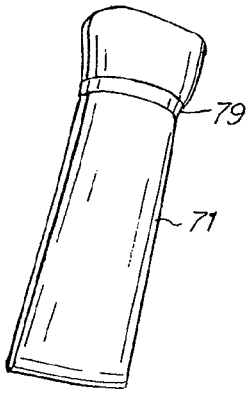
FIG. 12*c* is a perspective view of the configurable inflatable device of FIG. 12*a* in a folded configuration.

For example, referring to FIGS. 12*a-c*, there is illustrated another example of an inflatable device including one or more inflatable bladders in combination with a shape-controlling membrane. This structure may be used, for example, as a portable seating device, as shown in FIG. 12*a*. The membrane 71 may include one or more pockets, for example, a seat pocket 73 and a back pocket 75. Each pocket may include an opening to allow insertion of an inflatable bladder, as illustrated by arrows 78 in FIG. 12*b*. When the inflatable bladders are inserted into the seat and back pockets 73, 75 and inflated, a chair-like comfort device may be provided. Of course, inflatable bladders need not be inserted into both pockets, but may also be inserted into only one of either the seat pocket 73 or back pocket 75, if desired. Alternatively, once inserted, only one of the bladders may be inflated. In yet another example, a single inflatable bladder may be folded approximately in half and inserted into both pockets; one end into each pocket. The membrane 71 may include openings 77 to allow direct access to valves on the inflatable bladders so that the inflatable bladders may be inflated or deflated after insertion into the pockets. The device may also include one or more straps 79 that may be used to carry the device or to attach the device to a rigid surface, for example, a metal chair or stadium seat. As shown in FIG. 12*c*, the device may be folded, when the inflatable bladders are deflated or removed, for transportation or storage. The straps 79 may be used to secure the device in the folded configuration, as shown.

Figure 13A:
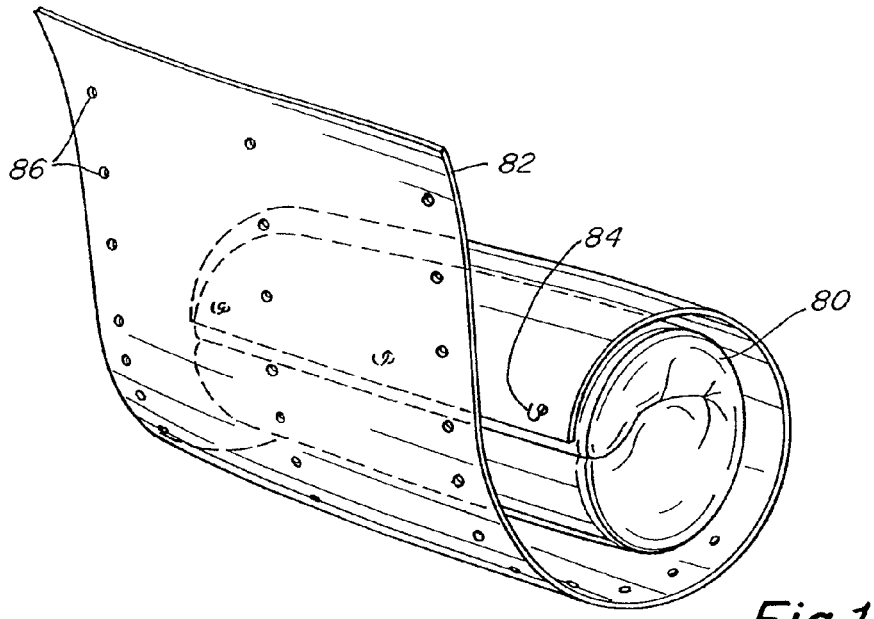
FIGS. 13*a-c* are perspective views of one embodiment of an inflatable bladder in combination with a membrane forming a bolster-type pillow.
Figure 13B:
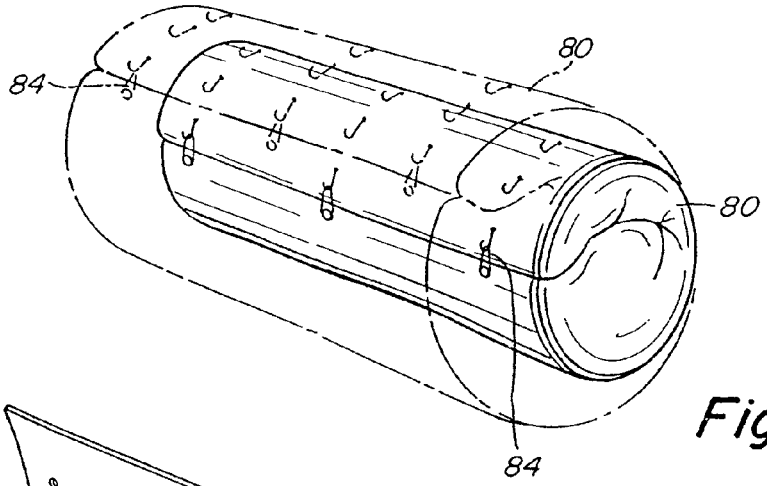
Figure 13C:
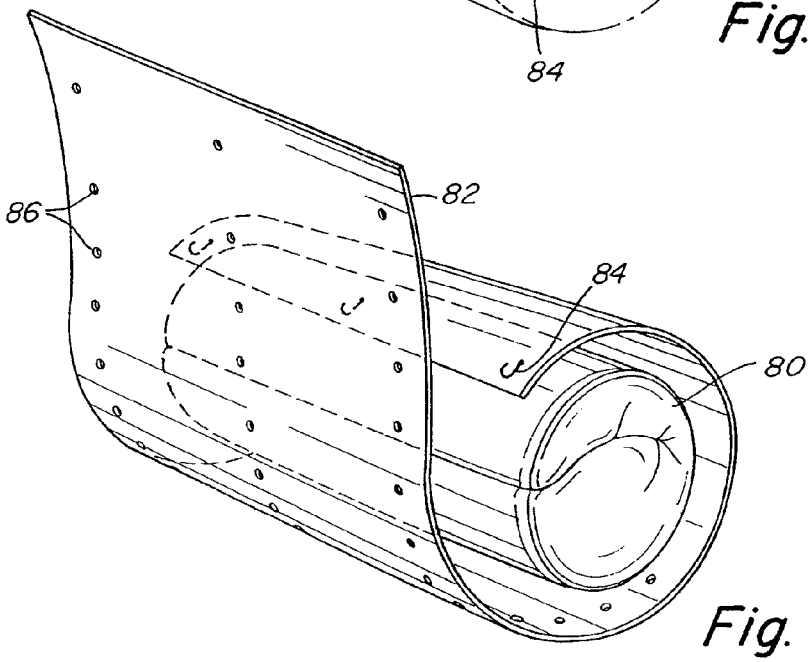

According to another embodiment, a configurable inflatable device may include one or more inflatable bladders in combination with a shape-defining membrane/covering layer. Referring to FIGS. 13*a-c*, there is illustrated one embodiment of an inflatable device that may be used as a bolster-type pillow. In this example, an inflatable bladder 80 may be combined with a membrane/covering layer 82. As shown in FIG. 13*a*, the membrane/covering layer 82 may be a planar membrane that may be rectangular and may be wrapped around the inflatable bladder 80 such that the overall structure may have a cylindrical tubular shape. However, it is to be appreciated that the bladder may not necessarily be cylindrical, and may be combined with the membrane/covering layer so as to form a structure having a shape that is not cylindrical, as will be discussed in more detail below. Furthermore, the membrane/covering layer 82 need not be rectangular, but may have another shape conducive to an overall desired shape of the structure.

In one example, the bladder 80 may be formed from a material that is flexible, and possibly somewhat elastic, while being substantially impermeable to fluids such as water or air. This flexibility of the bladder material, combined with the fact that the degree of inflation of the bladder (amount of fluid injected into the bladder) may be varied, may result in the bladder being highly malleable and configurable. Furthermore, the bladder may also be used in combination with the configurable, attachable membrane/covering layer 82, which allows the shape of the inflatable structure to be further controlled. For example, the configurable, attachable membrane may restrict inflation of certain parts of the inflatable bladder, thereby altering the shape of the bladder when inflated. In one example, the membrane/covering layer 82 may be provided with fasteners 84 that may be used to fasten the membrane around the inflatable bladder 80, as illustrated. The fasteners may be hook and loop fasteners, such as, for example, Velcro® hook and loop fasteners, or larger hook and loop fasteners as illustrated, or may be another type of fastener, for example, buttons, snaps, adjustable straps, or the button latch fastener discussed above. In one example, illustrated in FIGS. 13*a* and 13*c*, the membrane/covering layer 82 may be provided with a plurality of holes 86 and a row of hook fasteners 84, such that a diameter of the structure may be controlled by hooking the fasteners 84 into an appropriate row of holes 86. Alternatively, the inflatable bladder 80 may be provided with fasteners 84 that may allow a portion of the bladder to attach to another portion, thus controlling a shape of the bladder, with or without attachment of the membrane/covering layer, as illustrated in FIG. 13*b*.

In the example of a bolster-type pillow, the inflatable bladder may be substantially contained within the membrane/covering layer, which may be fastened so as to provide a pillow with a certain desired diameter. Once a desired diameter of the pillow has been selected, the bladder may be inflated as much as allowed by the constraining membrane/covering layer and/or fasteners, i.e., to completely fill the set diameter, to provide firm support to the user. Alternatively, the bladder may be less inflated so as not to completely fill the volume defined by the set diameter, should the user desire the device to be less firm or more malleable. For example, the diameter of the bolster pillow may be controllable from approximately 10" (25.4 cm) when fully inflated to approximately 3" (7.62 cm) when only partially inflated. Controlling the diameter of the pillow using adjustable fasteners has the advantage of maintaining the substantially cylindrical shape of the pillow even when the bladder is not fully inflated, to still provide support to the user. Although the above features of the inflatable device have been described in terms of a controllable diameter with reference to a bolster pillow, it is to be appreciated that the device is not limited to this structure, and the principles here described may be applied to other structures having non-cylindrical shapes.

According to another example, the membrane/covering layer may have an envelope-type structure that encompasses at least a portion of the inflatable bladder. The malleability and reconfigurability of the inflatable bladder combined with adjustment means such as the fasteners, may provide a pillow, or other device, the size and shape of which may be easily modified as desired. The inflatable bladder may be provided with a valve to allow for easy inflation and deflation. In situations where additional structure may be required or desirable, the attachment or adjustment means may allow a rigid member to be combined with the bladder to provide the additional structure.

Figure 14A:
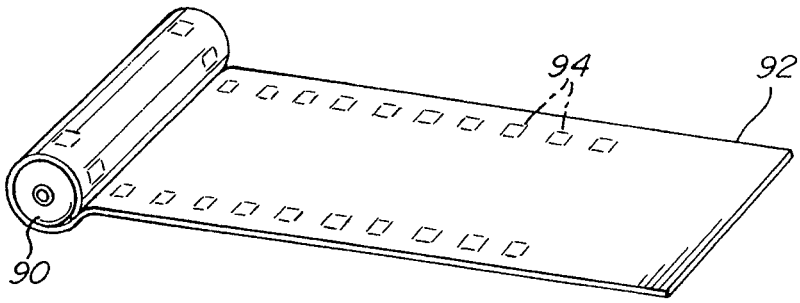
FIG. 14*a* is a perspective view of another embodiment of a configurable inflatable device according to aspects of the invention.
Figure 14B:
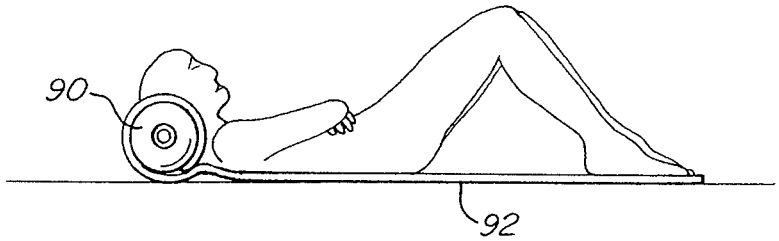
FIGS. 14*b* and 14*c* are side views of the configurable inflatable device of FIG. 14*a;*
Figure 14C:
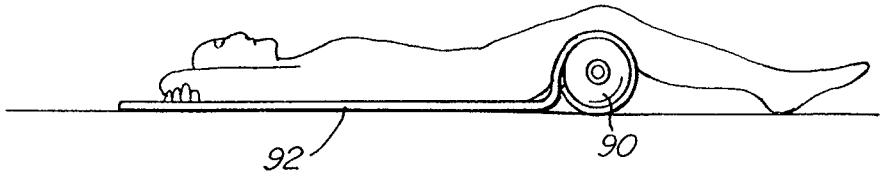

FIGS. 14*a-c* illustrate another example of an inflatable device that comprises an inflatable bladder 90 and a flexible membrane 92. It is to be appreciated that the membrane 92 may also form or include a covering layer that encompasses all or portion of the inflatable bladder 90. This structure may be used, for example, to support a body in a reclined position, as illustrated in FIGS. 14*b* and 14*c*, and may be used for recreational or therapeutic purposes. According to one example, the structure may include an inflatable bladder 90 that may be at least partially enclosed within a portion of the membrane 92 (as illustrated), or may have means of attachment to, for example, one edge of the membrane 92. The membrane 92 may be a generally rectangular membrane, as illustrated, although the membrane may have another shape if desired. The membrane 92 may be a planar membrane. The inflatable bladder 90 may have a tubular shape, or be have another shape and be constrained by the membrane to form a cylindrical shape. In another example, the inflatable bladder may be enclosed within a covering layer, or may have fasteners to attach portions of the bladder to other portions of the bladder, such that the bladder may be provided as a bolster-type pillow as described above. The bolster-type pillow may then be attached to the membrane 92 as a separate entity.

The inflatable bladder may be positioned to elevate and support the body at various points, as illustrated in FIGS. 14*b* and 14*c*. The means of attachment of the tube portion to the membrane may be hook and loop fastener tabs 94 placed on both sides of the membrane, or on one side of the membrane and on the inflatable bladder, as illustrated in FIG. 14*a*. Alternatively, the attachment devices may be buttons, snap fasteners, or other types of fasteners, such as the button latch fastener mentioned above. The attachment devices may also be used for adjusting the length of the membrane so as to better accommodate variation of body size and variation of reclining comfort positions. In another example, the structure may accommodate winding of the membrane around the inflatable bladder, thereby adjusting the diameter of the tube portion and the length of the membrane, and may provide means for securing the membrane in a variety of positions. It is to be appreciated that although the above-described example shows one inflatable bladder, the device is not so limited and multiple bladders are envisioned for use within this general embodiment.

Figure 15A:
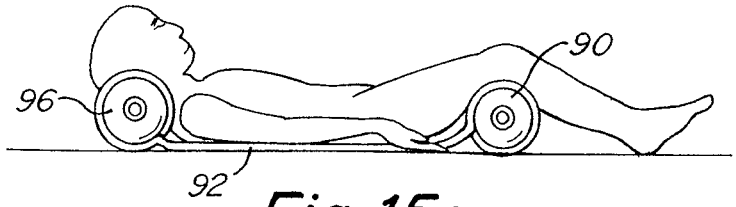
FIGS. 15*a-c* are side views of applications of another embodiment of a configurable inflatable device according to aspects of the invention.
Figure 15B:
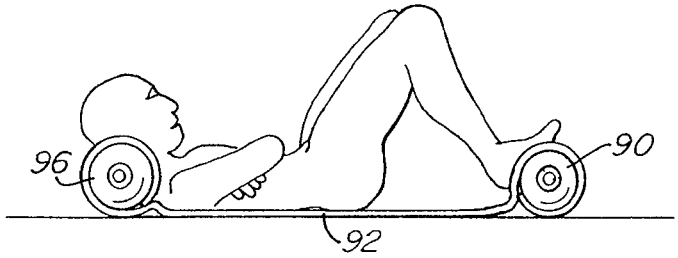
Figure 15C:
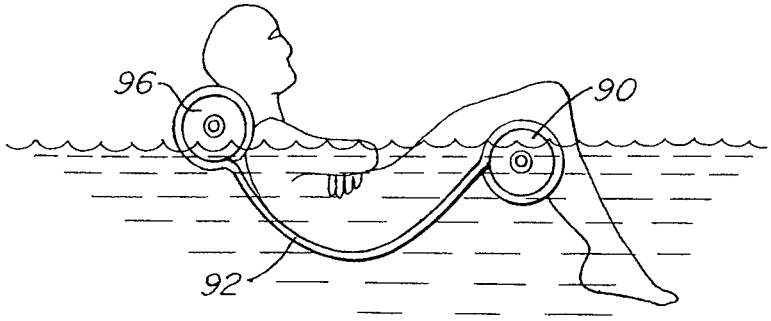
Figure 15D:
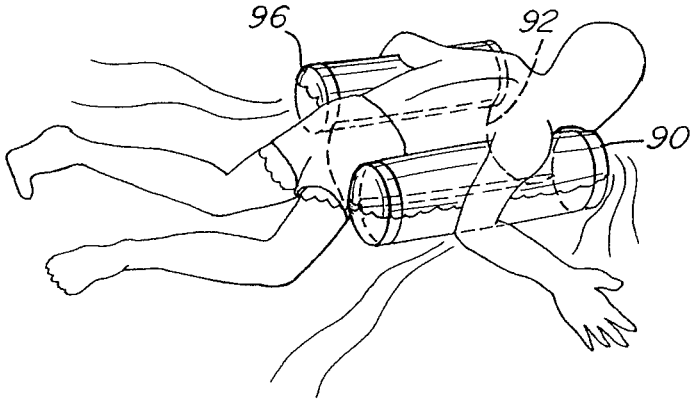
FIG. 15*d* is a perspective view of an application of the configurable inflatable device of FIGS. 15*a-c;*

According to another embodiment, additional inflatable bladders may be attached to the planar membrane to provide various configurable inflatable structures. FIGS. 15*a-d* illustrate an example of an inflatable device comprising a second inflatable bladder 96 as well as the first inflatable bladder 90 and planar membrane 92 that were illustrated in FIGS. 14*a-c*. In the illustrated example, the two inflatable bladders 90, 96 may be configured in parallel attachment to the membrane 92, each at one of two opposing edges, and may be positioned, for example, so as to provide elevated support or buoyancy for legs at one end, and head and neck/upper torso at the other. This structure may be used both on land and in water, as illustrated. The membrane 92 may serve as a tension member, preventing the inflatable bladders from separating and/or from losing alignment. When the structure is used in water, the membrane 92 may further serve as a "sling", for example, cradling a body in suspension between the inflatable bladders, as illustrated in FIGS. 15*c* and 15*d*. The inflatable bladders may be detachable from the membrane, and may include covering layers in addition to the membrane 92, as discussed above.

Figure 16:
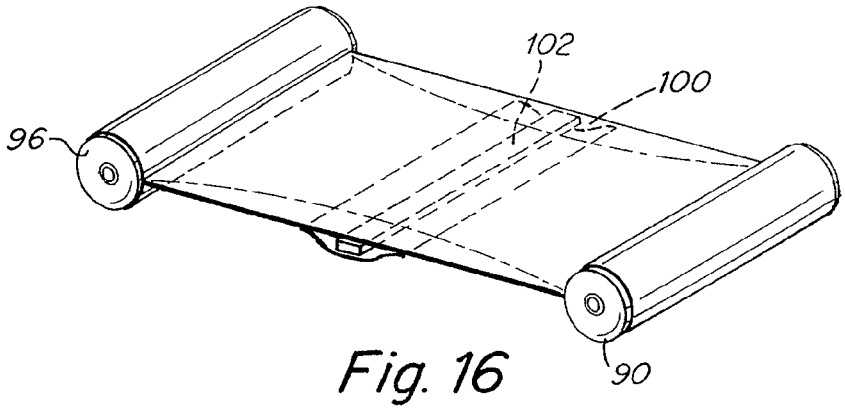
FIG. 16 is a perspective view of another embodiment of a configurable inflatable device according to aspects of the invention.

According to another example, illustrated in FIG. 16, the structure may be used in combination with a lateral stiffening member 102 (lateral meaning parallel to the length of the tube portions). The stiffening member 102 may be, for example, a rigid or flexible plate, and may serve to substantially reduce flexure of the membrane's surface in one dimension. The stiffening member may also help to prevent the inflatable tubes from collapsing towards each other in response to point load bearing, or from the weight of body limbs. The planar membrane 98 may be provided with openings 100 along the sides to allow insertion of the stiffening member 102 into the membrane 98. The openings 100 may be, for example, slightly wider than the stiffening member 98, such that the stiffening member may be placed at a predetermined position along the membrane 98. Alternatively, the openings 100 may extend along a predetermined length of the membrane 98, such that the stiffening member may be moved within the membrane 98 to a desired position. In this example, the stiffening member 102 may be provided with fasteners to attach it to the membrane 98 and prevent it from sliding or otherwise moving within the membrane 98.

Figure 17A:
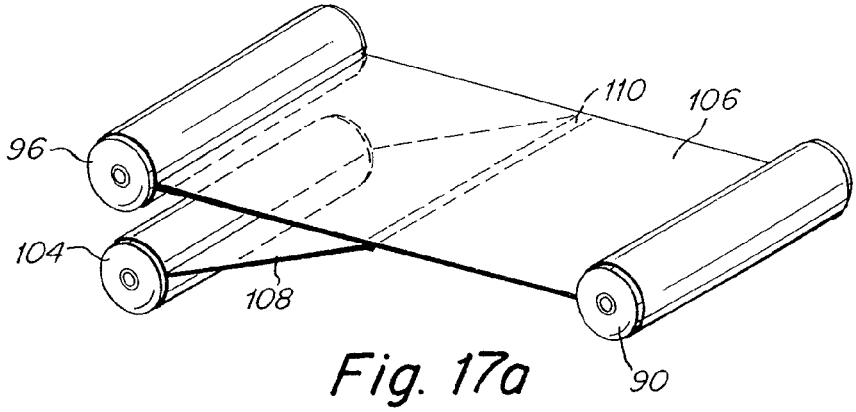
FIG. 17*a* is a perspective view of another embodiment of a configurable inflatable device according to aspects of the invention.
Figure 17B:
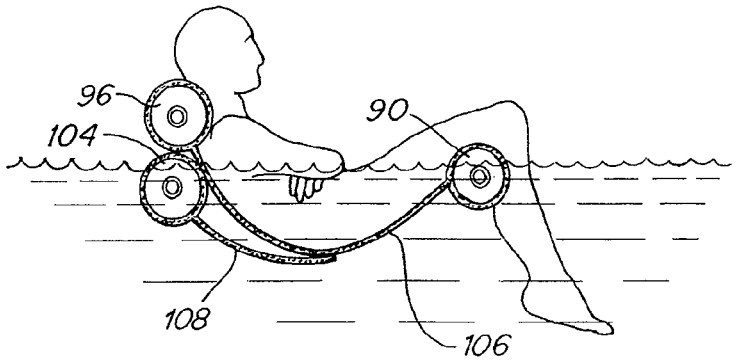
FIGS. 17*b* and 17*c* are side views of an application of the configurable inflatable device of FIG. 17*a;*
Figure 17C:
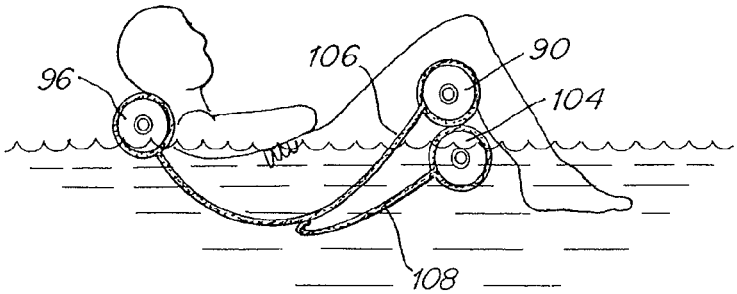

FIGS. 17*a-c* illustrate another embodiment of a configurable inflatable structure, wherein an additional inflatable bladder 104 may be attached to the planar membrane 106 to improve buoyancy/comfort of the structure. In one example, the additional inflatable bladder 104 may be attached to an additional membrane section 108. The additional membrane section 108 may be attached to the planar membrane 106 along an attachment line 110, for example, near a center of the planar membrane 106. The additional inflatable bladder 104 and membrane section may be permanently attached, or may be detachable, with fasteners such as, for example, buttons, snaps, hook and loop fasteners, or another type of other secure fasteners, that may be provided along attachment line 110 and along an edge of the additional membrane section 108.

In another example, the additional inflatable bladder 104 and membrane section 108 may be attached such that the additional inflatable bladder 104 may pivot to either end of the membrane 106, creating options for buoyancy or comfort. For example, FIGS. 17*b* and 17*c* illustrate an attached additional inflatable bladder 104 adding buoyancy beneath the torso or legs of a person supported by the structure. In another example, a plurality of additional inflatable bladders may be combined with the planar membrane 106, with or without additional membrane sections, so as to provide flotation/support devices of various configurations. The additional inflatable bladders need not necessarily be of the same size as the inflatable bladders 90 and 96. The inflatable bladders may be provided in a variety of sizes and may be detachable so that they may be combined in a way which permits flexibility of arrangement of the components, allowing for variability of buoyancy/comfort. For example, there may be two large tubes at one end, a small tube at other end, or there may be a large and a small tube at one end, and large tube at other end, or some other combination. It is to be appreciated that while the above examples have been described and illustrated in terms of tubes that may be substantially cylindrical, the inflatable devices are not so limited, and the inflatable bladders may have any desired shape, such as, for example, dumbbell, hemispherical, etc.

In another example, the membrane 106 may have a contoured width to further improve flexibility of the structure, particularly when used in water. For example, the membrane may have a narrow section at one end, and widen towards the other end. The open area created by the narrow section may allow the legs of the user to be alternatively draped over a tube, or to be suspended into the open area between tubes, in which case the user assumes a seated rather than a reclined posture. Furthermore, the membrane 106 need not be substantially rectangular, and may be, for example, circular, or have another shape as desired.

Figure 18:
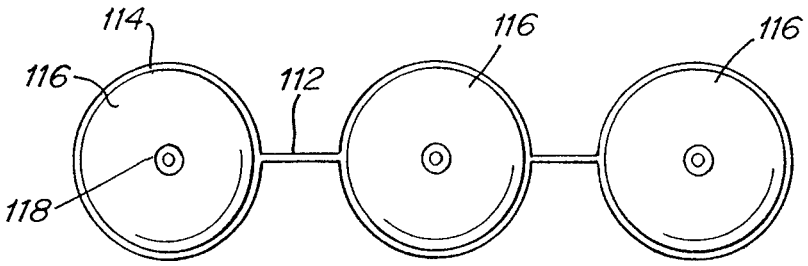
FIG. 18 is an end view of another embodiment of a configurable inflatable device according to aspects of the invention.
Figure 19:
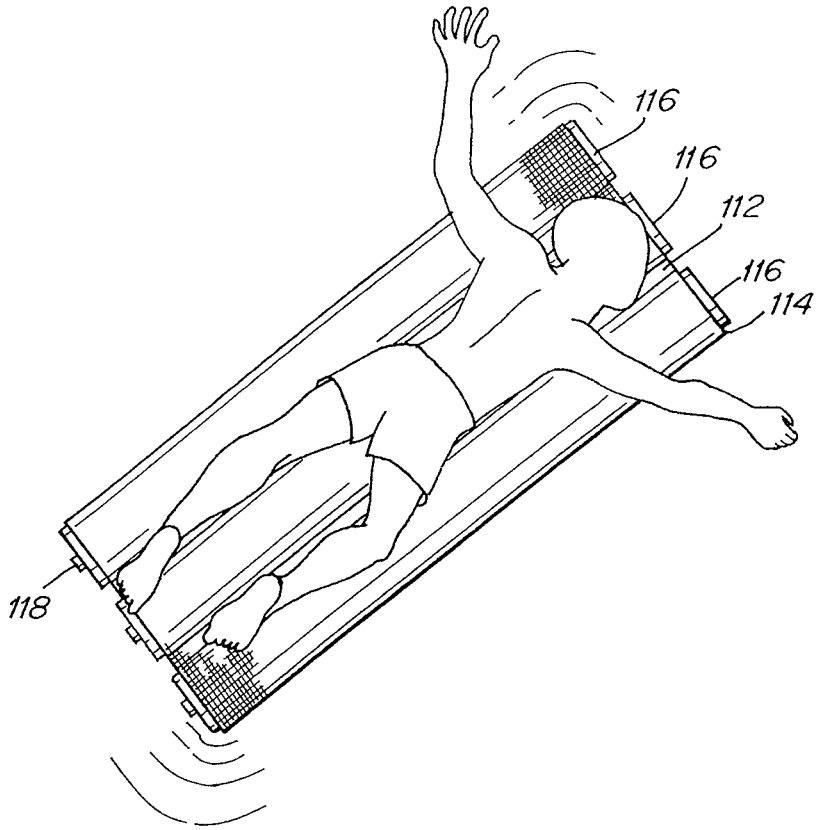
FIG. 19 is a perspective view of one example of an application of the configurable inflatable device of FIG. 18.

According to yet another embodiment, illustrated in FIG. 18, a configurable inflatable device may include a membrane 112 that may have one or more openings that form sleeves 114. A corresponding one or more inflatable bladders 116 may be inserted into the sleeves 114, as shown. FIG. 18 illustrates one example of such a configurable inflatable device, wherein the membrane 112 includes three sleeves 114, arranged side-by-side and connected by portions of the membrane 112. Corresponding inflatable bladders 116 may be inserted into the sleeves 114, and inflated. The inflatable bladders 116 may be provided with valves 118 for inflation and deflation. The length of the interconnecting portions of the membrane 112 may determine the amount of space between the inflatable bladders, and may be uniform or may vary between different sleeves. By altering the length of the portions of the membrane 112, and/or by altering the length and/or diameter of the inflatable bladders 116, various configurations may be achieved to accommodate alternative needs for flotation or support. Such alteration may be accomplished in a single version of the device—i.e. a single device may be alterable to provide different configurations. Referring to FIG. 19, there is illustrated an example of how the inflatable device of FIG. 18 may be used to support a person.

In another example, additional inflatable bladders, that may be in the form of a tube or a pillow, may be provided that need not be attached or connected to the membrane 112. Comfort or support may be improved by the use of one or more such additional inflatable bladders, which may be either 'free' (disconnected) or attached to the membrane 112, and may be provided with covering layers. Furthermore, it is to be appreciated that while the above examples are discussed in terms of inflatable bladders in combination with a membrane, the membrane may also include a covering layer, or may serve as covering layer. As discussed above, membranes and covering layers may be used interchangeably in combination with one or more inflatable bladders to provide a variety of inflatable structures.

Figure 20A:
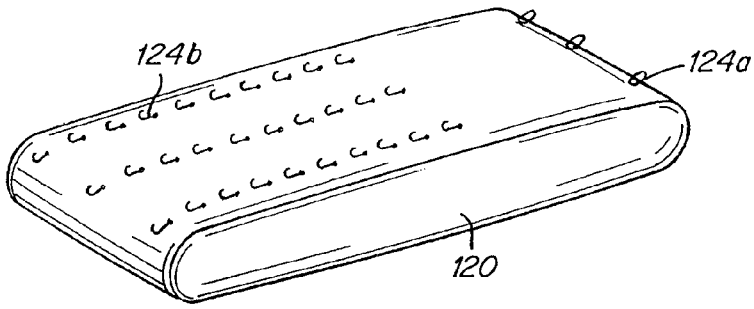
FIGS. 20*a-c* are perspective views of yet another embodiment of an inflatable device including an inflatable bladder and an attachable covering layer.
Figure 20B:
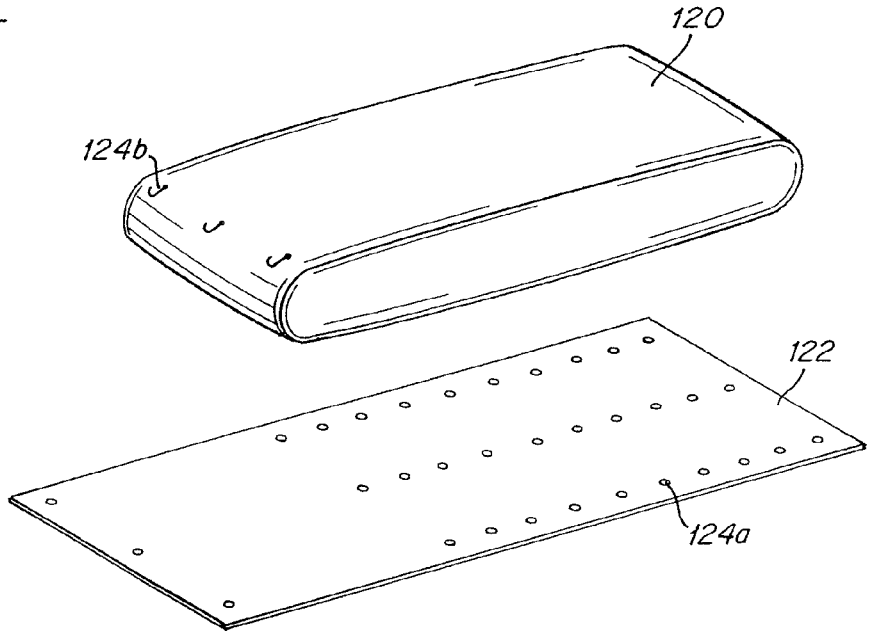
Figure 20C:
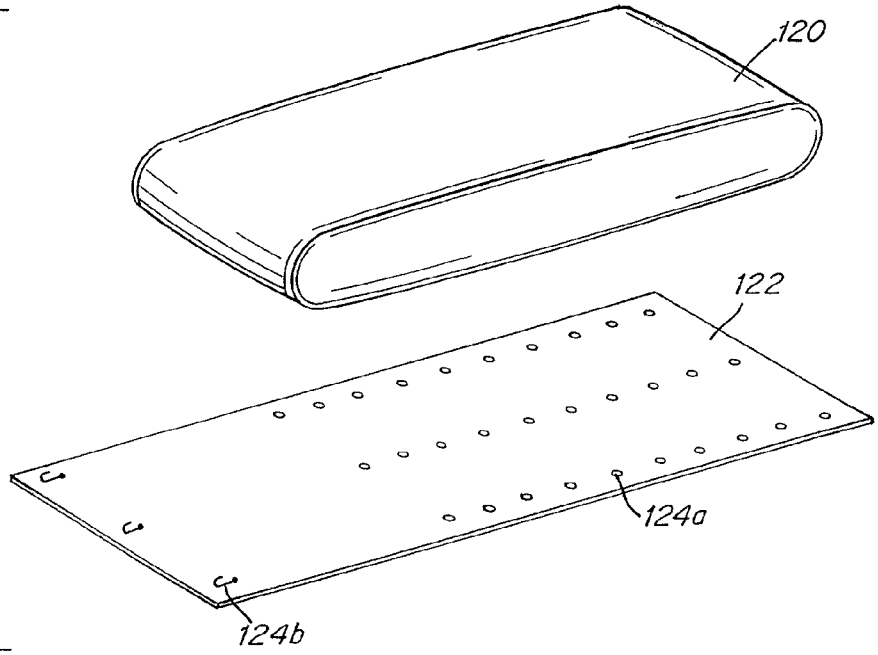

Referring to FIGS. 20*a-c*, there are illustrated examples of yet another embodiment of a configurable inflatable device that may be used as a mattress, for example, a camping mattress. As shown in FIGS. 20*a-c*, the device may include an inflatable bladder 120 that may be fully or partially surrounded by a covering layer 122, as discussed above. In one example, the inflatable bladder may be provided with fasteners 124*a,b* that may be used to attach the covering layer 122 to the inflatable bladder. In this example, the covering layer 122 may only partially cover the inflatable bladder 120, for example, the covering layer 122 may be attached to only one side of the inflatable bladder 120, and need not completely surround it. The fasteners may be, for example, hook and loop fasteners as shown, snap fasteners, buttons, adjustable straps, or another type of fastener. In the example illustrated in FIG. 20*a*, the inflatable bladder may be provided with a row of loops 124*a*, and the covering layer 122 may be provided with a plurality of rows of hooks 124*b*, such that the covering layer 122 may be attached to the inflatable bladder by hooking one of the plurality of rows of hooks 124*b* into the row of loops 124*a*. Of course it is to be appreciated that the illustrated example is only one method of attaching the covering layer to the inflatable bladder and numerous other methods and types of fasteners are available and may be used. For example, the inflatable bladder may be provided with a row of hooks 124*b* and the covering layer 122 may have a plurality of rows of holes or loops 124*a*, as illustrated in FIG. 20*b*. Thus, the covering layer 122 may be attached to the inflatable bladder 120 by hooking one of the plurality of rows of loops 124*a* onto the hooks 124*b*. Alternatively, the covering layer 122 may be provided with fasteners that attach portions of the covering layer to itself, as illustrated in FIG. 20*c*. In this example, the covering layer may be wrapped around the inflatable bladder 120 and may substantially encompass the bladder 120, similarly to the bolster-type pillow example illustrated in FIGS. 13*a-c*. Again, hook and loop fasteners are illustrated in FIG. 20*c*, however, the fasteners may be of any suitable type of fastener as discussed above.

In one example, the covering layer 122 may be a comfort layer and may be quilted and/or formed of a comfort-enhancing fabric, as discussed above. The materials that may be used for construction of the inflatable bladder generally must be substantially impermeable to air, or another inflating agent, and sealable. However, materials used for the covering layer 122 are not so constrained, and may be chosen to enhance the comfort characteristics of the inflatable device, such as softness, warmth, etc. The covering layer may also be padded or quilted and may include several layers for softness and/or durability.

Figure 21A:
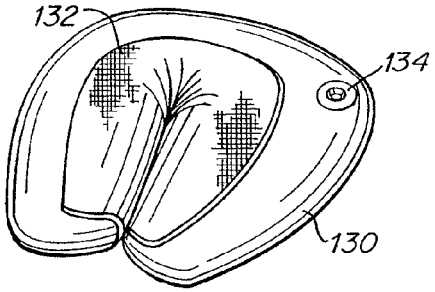
FIGS. 21*a-d* are perspective views of examples of another embodiment of a configurable inflatable structure according to aspects of the invention.
Figure 21B:
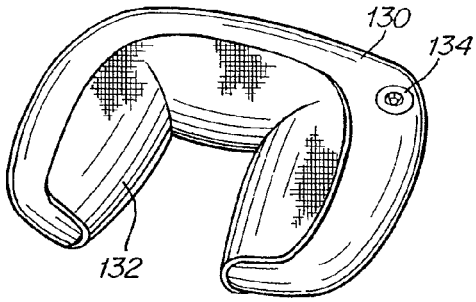
Figure 21C:
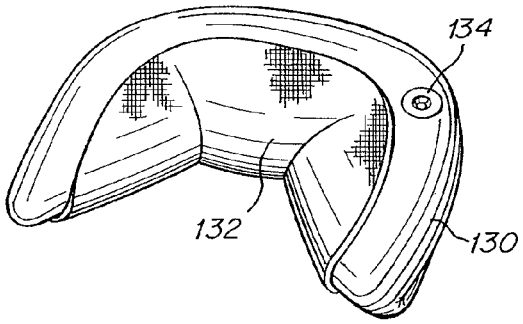
Figure 21D:
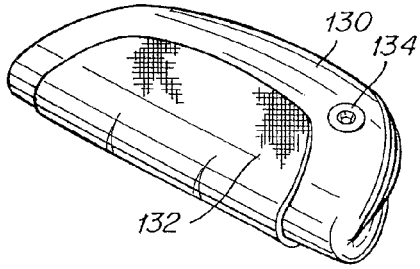

Referring to FIGS. 21*a-d*, there is illustrated examples of another embodiment of a configurable inflatable device comprising an inflatable bladder 130 in combination with a partial outer membrane 132. This type of inflatable device may be referred to as a pillow, although it may serve other functions and may be used in other applications, not only as a pillow. The inflatable bladder 130 comprises a valve 134 for inflation and deflation. The partial outer membrane 132 may be provided in the form of an attachable collar and the shape of the pillow, or cushion, may be controlled by variations in how the collar and the inflatable bladder 130 are attached, and the level of inflation. The pillow structure may provide a variety of comfort shape options, for example, a circle as shown in FIG. 21*a*, a "U" as shown in FIG. 21*b*, a crescent as illustrated in FIG. 21*c*, or a substantially straight tube as illustrated in FIG. 21*d*. In one example, the partial outer membrane 132 may be a quilted or padded comfort layer, and/or may be include a comfort-enhancing fabric.

Figure 22A:
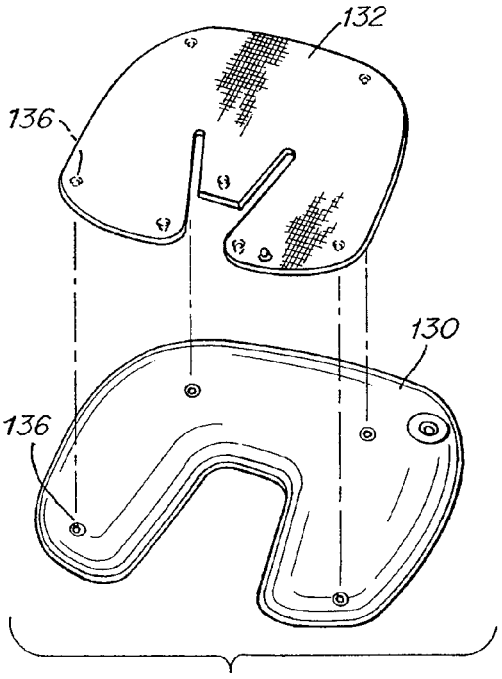
FIGS. 22*a* and 22*b* are exploded views of an inflatable bladder and a partial outer membrane.
Figure 22B:
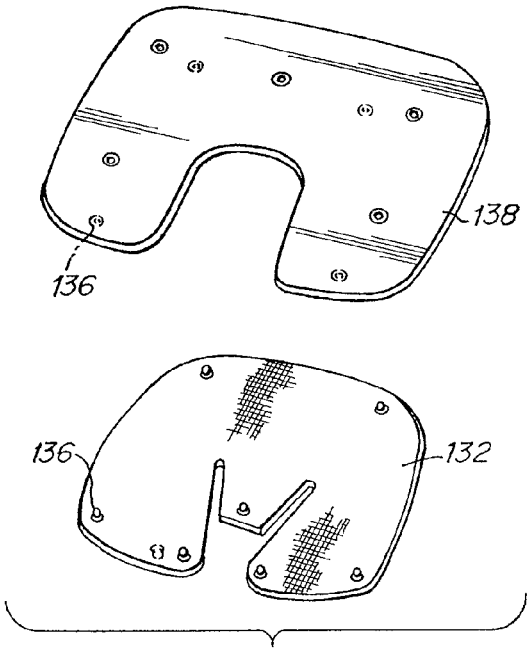
Figure 23A:
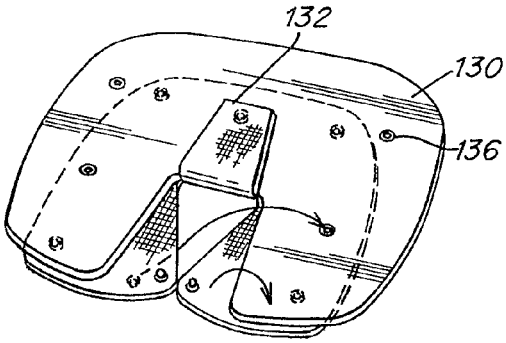
FIGS. 23*a-h* are perspective views of various examples of configurable inflatable structures formed by an inflatable bladder in combination with a partial outer membrane.
Figure 23B:
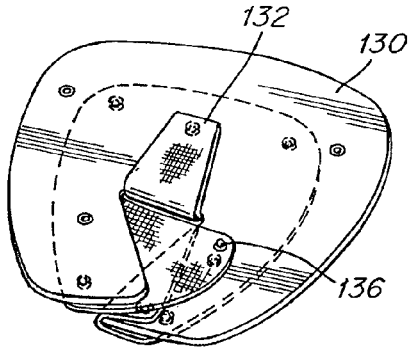
Figure 23C:
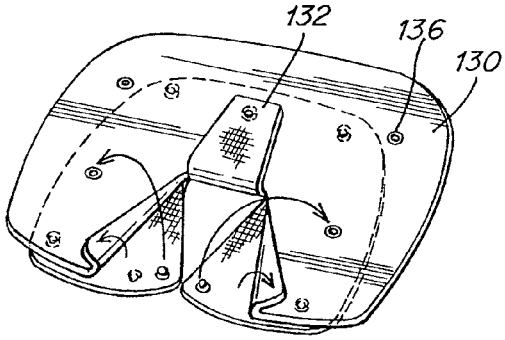
Figure 23D:
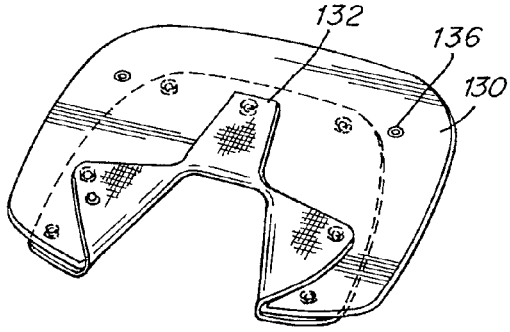
Figure 23E:
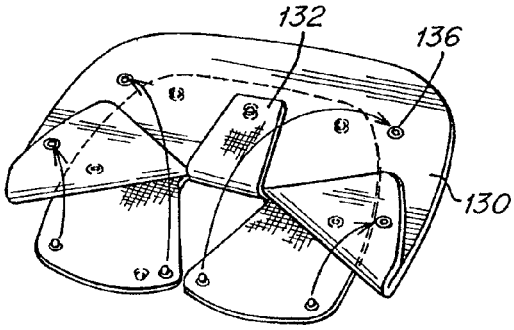
Figure 23F:
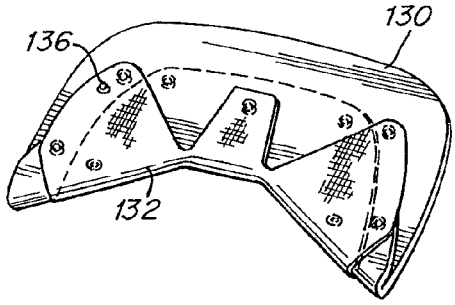
Figure 23G:
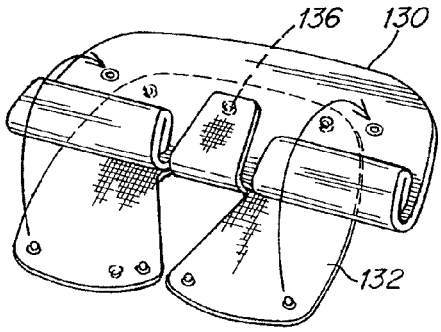
Figure 23H:
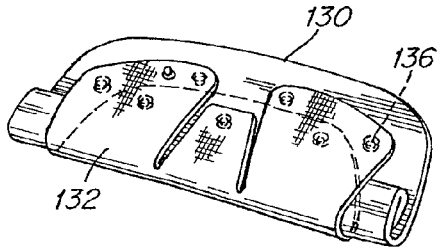

Referring to FIGS. 22*a* and 22*b*, the inflatable bladder 130 may be attached to the partial outer membrane 132 using fasteners 136. In one example, fasteners 136 may be provided on both the inflatable bladder 130 and on the partial outer membrane 132, such that the partial outer membrane 132 may be attached to the inflatable bladder 130. The fasteners may be snap fasteners as illustrated. For example, the partial outer membrane 132 may include the protruding portion of the snap fastener 136, as illustrated in FIG. 22*a*, and the inflatable bladder 130 may include the corresponding mating portion. Alternatively, the fasteners may be provided with the protruding portion attached to the inflatable bladder. The fasteners may also be another type of fastener, such as, for example, button fasteners, hook and loop fasteners, etc. By fastening the partial outer membrane to the inflatable bladder in various ways, using some or all of the fasteners provided, the structure may be made to take a desired shape, such as the shapes illustrated in FIGS. 21*a-d*. Alternatively, a second partial outer membrane 138 may be provided, as illustrated in FIG. 22*b*, and the structure may be formed by attaching the first partial outer membrane 132 to the second partial outer membrane 138, by means of fasteners 136, with the inflatable bladder placed between the two membranes. According to another example, the outer membrane may removably substantially completely surround the inflatable bladder, and may include an opening to provide direct access to the valve.

Referring to FIGS. 23*a-h*, there are illustrated several examples of attaching combinations of the inflatable bladder 130 and the partial outer membrane 132. The partial outer membrane 132 may, by its attachment, constrain the inflatable bladder 130 upon inflation and may cause it to assume a shape other than the shape the inflated bladder 130 alone would naturally assume upon inflation. The variability in the manner in which the partial outer membrane may be attached to the inflatable bladder provides a device that is highly configurable and allows a single inflatable bladder of one shape to be used in a variety of applications.

Figure 24:
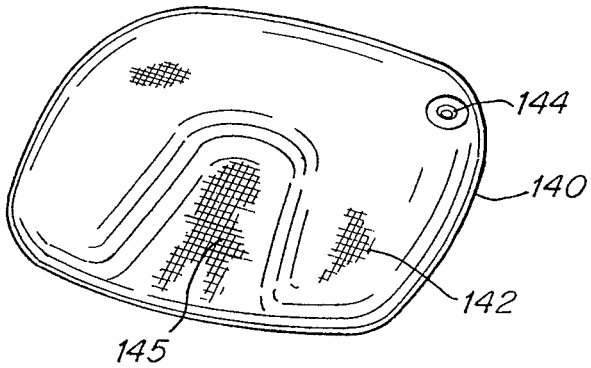
FIG. 24 is a perspective view of another embodiment of a configurable inflatable device according to aspects of the invention.

According to yet another embodiment of a configurable inflatable device, an inflatable bladder 140, having a valve 144 for inflation and deflation, may be enclosed, or partially enclosed, within a covering layer 142, as illustrated in FIG. 24. The covering layer 142 may be made of a flexible material such as rubber, a cotton mesh, or any other material used in the art, and may have a volume different from that of the inflatable bladder 140. For example, the covering layer 142 may be sized and configured so as to constrain the size and/or shape of the inflatable bladder to provide a resulting inflatable device structure that is different than that of the bladder itself. With this arrangement, the bladder and covering layer in combination provide an inflatable device having a different volume and shape than that exhibited by the bladder itself. In addition, it is to be understood that the flexibility of the inflatable bladder material, and the degree of variability provided by the ability to adjust the level of inflation of the bladder, provide an inflatable device having a plurality of levels of comfort. Inflation of the inflatable bladder 140 within the covering layer 142 may also provide a comfort and/or support surface that may not be provided by the inflatable bladder 140 alone. For example, a U-shaped inflatable bladder may be contained within an approximately rectangular covering layer, as illustrated in FIG. 24, thereby providing a pillow having a support/comfort area 145 that includes the covering layer, but where there is no portion of the inflatable bladder present. Thus, this structure may provide different comfort and/or support features from those that the U-shaped inflatable bladder may provide on its own, or with a shape-conforming covering layer.

Figure 25:
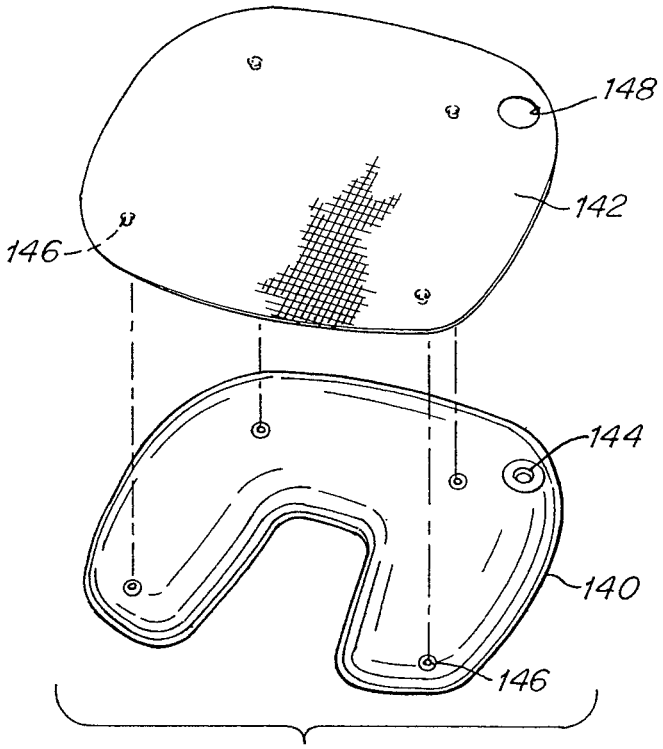
FIG. 25 is an exploded view of yet another embodiment of a configurable inflatable device according to aspects of the invention.

It is to be appreciated that FIGS. 24 and 25 illustrate examples of an inflatable bladder in combination with a covering layer, but that many different inflatable devices having a number of possible comfort surfaces may be obtained through the combination of various bladder shapes and volumes with covering layers of different shapes, sizes, and materials. For example, referring to FIG. 25, the covering layer 142 may not completely enclose the inflatable bladder 140, but may be provided with fasteners 146 that may be used to attach the covering layer 142 to a portion of the inflatable bladder 140. The fasteners may be, for example, hook and loop fasteners, adjustable straps, buttons, snap fasteners, or another type of fastener known to those of skill in the art. According to another example, the covering layer may be provided in the form of a bag, for example, a drawstring bag, that may surround the inflatable bladder. In certain examples, the covering layer 142 may also be provided with a hole 148 to allow a user to access the valve 144 to inflate and/or deflate the inflatable bladder 140 once it is inside or partially covered by the covering layer 142.

Various illustrative examples of inflatable devices comprising inflatable bladders and membranes have been described above in terms of particular shapes. However, it is to be appreciated that the inflatable bladder may be provided in a variety of shapes and sizes and may be combined with a variety of attachable membranes, rigid members and covering layers. Thereby, many configurable inflatable devices may be obtained, which may have structures different from the structure of the inflatable bladder alone. Also, by attaching the membranes or covering layers in different ways, as discussed, a variety of configurable structures may be obtained using a single inflatable bladder. Furthermore, the inflatable structures may be further adjustable and configurable by controlling the degree of inflation of the inflatable bladders. For example, for inflatable bladders equipped with a self-sealing valve, as discussed above, by manipulating the hanger arm of the valve, the firmness (degree of inflation) of the inflatable bladder may be controlled, which may in turn partially control the shape and utility of the inflatable structure. The above description is therefore by way of example only, and includes any modifications and improvements that may be apparent to one of skill in the art. The scope of the invention should be determined from proper construction of the appended claims and their equivalents.

What is claimed is:

1. An inflatable device comprising:

an inflatable bladder adapted to support at least a part of a body of a user; and at least one flexible shape-defining member sized only to partially cover an outer surface of the inflatable bladder and configured to adjust a shape of the inflatable bladder to a configuration desired by the user by constraining the inflatable bladder to a volume to which the inflatable bladder can be inflated, the volume defined by at least a portion of the at least one flexible shape defining member, wherein the configuration and the volume are selected from a plurality of available configurations and a plurality of available volumes, respectively, in which the inflatable device may be employed to provide support, wherein the plurality of available configurations and the plurality of available volumes are independent of whether the inflatable device is supporting the at least the part of the body of the user at a time of configuration, and wherein the at least one flexible shape-defining member is configured such that adjustments to the at least one flexible shape-defining member adjust the shape and the configuration of the inflatable bladder to provide adjustments to the volume to which the inflatable bladder can be inflated at each of the plurality of available configurations relative to others of the plurality of configurations.

2. The inflatable device of claim 1, wherein the at least one flexible shape-defining member is removably coupled to the inflatable bladder.

3. The inflatable device of claim 1, wherein the volume corresponds to an overall shape of the inflatable device.

4. The inflatable device of claim 1, wherein the at least one flexible shape-defining member includes a first partial membrane adapted to attach to the inflatable bladder.

5. The inflatable device of claim 4, wherein the at least one flexible shape-defining member includes a second partial membrane adapted to attach to the first partial membane.

6. The inflatable device of claim 1, wherein the plurality of available configurations include any one of a tube-shape, a U-shape and a crescent-shape.

7. The inflatable device of claim 1, wherein the inflatable bladder includes a valve wherein the at least one flexible shape-defining member includes at least one opening through which the valve is accessible.

8. The inflatable device of claim 1, wherein the inflatable device includes a fastener selected from a group consisting of a hook and loop fastener, a button fastener and a snap-type fastener.

9. The inflatable device of claim 1, wherein the at least one flexible shape-defining member includes a flexible membrane.

10. The inflatable device as claimed in claim 9, wherein the flexible membrane at least partially encompasses the inflatable bladder.

11. The inflatable device as claimed in claim 10, wherein the flexible membrane include a first fastener for attaching the flexible membrane to the inflatable bladder.

12. The inflatable device as claimed in claim 11, wherein the inflatable bladder includes a second fastener adapted to mate with the first fastener so as to attach the flexible membrane to the inflatable bladder.

13. The inflatable device as claimed in claim 9, wherein the at least one flexible shape-defining member includes a covering layer that at least partially encompasses the inflatable bladder.

14. The inflatable device as claimed in claim 9, wherein the inflatable bladder includes a self-sealing valve.

15. The inflatable device as claimed in claim 9, wherein the member includes a covering layer that at least partially surrounds the inflatable bladder.

16. The inflatable device as claimed in claim 15, wherein the covering layer is attached to at least one side of the inflatable bladder.

17. The inflatable device as claimed in claim 15, wherein the covering layer is quilted.

18. The inflatable device as claimed in claim 9, wherein the inflatable bladder is U-shaped.

19. The inflatable device as claimed in claim 9, wherein the flexible shape-defining member includes a covering layer that is one of quilted and padded.

20. The inflatable device as claimed in claim 9, wherein the flexible shape-defining member includes a covering layer that at least partially surrounds the inflatable bladder.

21. The inflatable device as claimed in claim 20, wherein the covering layer includes a mesh material.

22. The inflatable device of claim 9, wherein the inflatable bladder includes a self-sealing valve, wherein the flexible membrane partially surrounds the inflatable bladder, wherein the flexible membrane has at least one fastener for securing the flexible membrane in position with respect to the inflatable bladder, wherein the flexible membrane at least partially controls an overall shape of the inflatable bladder when inflated, such that the overall shape of the inflatable device is different from an inflated shape of inflatable bladder alone.

23. The inflatable device as claimed in claim 9, wherein a portion of the flexible membrane at least partially encloses the inflatable bladder, and wherein the flexible membrane is configured to adjust a diameter of the inflatable bladder.

24. The inflatable device of claim 1, further including at least one pair of fasteners including a first fastener and a second fastener, coupled to the inflatable bladder, wherein the first fastener is adapted to mate with the second fastener to configure the inflatable bladder and provide a predetermined shape of the inflatable bladder when inflated.

25. The inflatable device as claimed in claim 24, further including a covering layer that at least partially covers the inflatable bladder.

26. The inflatable device of claim 1, wherein a combination of the at least one flexible shape-defining member and the inflatable bladder provides the inflatable device with an overall shape that is substantially different from a shape of the inflatable bladder alone.

27. The inflatable device as claimed in claim 1, wherein the plurality of available configurations include at least three configurations.

28. The inflatable device of claim 1, wherein the at least one shape-defining member includes a covering layer that is sized and shaped to provide a support area in a region where the inflatable bladder is not present.

29. The inflatable device of claim 1, wherein the at least one shape-defining member includes a first partial outer membrane and a second partial outer membrane.

30. The inflatable device of claim 29, wherein the first partial outer membrane and the second partial membrane are configured to fasten to one another.

31. The inflatable device of claim 30, wherein the inflatable device is configured to locate the inflatable bladder between the first partial outer membrane and the second partial outer membrane.

32. A method for configuring an inflatable device, the method comprising acts of:

combining a flexible shape-defining member with an inflatable bladder adapted to support at least a part of a body of a user, the inflatable bladder having a volume when unconstrained by the flexible shape-defining member; and constraining the inflatable bladder with at least a portion of the flexible shape-defining member sized to partially cover an outer surface of the inflatable bladder to provide a plurality of available configurations and a plurality of available volumes to which the inflatable bladder can be inflated, respectively, in which the inflatable device may be employed to provide support, wherein the plurality of available configurations and the plurality of available volumes are independent of whether the inflatable device is supporting the at least the part of the body of the user at a time of configuration and exist as a result of the combination of the flexible shape-defining member and the inflatable bladder, and wherein the at least one flexible shape-defining member is configured to adjust the volume to which the inflatable bladder can be inflated at each of the plurality of available configurations relative to others of the plurality of configurations.

33. The method of claim 32, further comprising an act of inflating the inflatable bladder by a predetermined amount to configure the inflatable device to the overall shape.

34. The method of claim 33, further comprising an act of determining a desired dimension of the inflatable device.

35. The method of claim 34, wherein the desired dimension is a diameter, and wherein the method further comprises an act of establishing the predetermined amount of inflation such that the inflatable bladder at least partially fills a volume defined by the diameter.

36. The method of claim 32, further comprising acts of selecting an overall shape of the inflatable bladder when inflated and inflating the inflatable bladder by a predetermined amount to configure the inflatable device to the overall shape.

37. An inflatable device comprising:

an inflatable bladder adapted to support at least a part of a body of a user; and at least one shape-defining member sized to partially cover an outer surface of the inflatable bladder and configured to adjust a shape of the inflatable bladder to a configuration desired by the user by constraining the inflatable bladder to a volume to which the inflatable bladder can be inflated, the volume defined by at least a portion of the at least one shape defining member, wherein the configuration and the volume are selected from a plurality of available configurations and a plurality of available volumes, respectively, in which the inflatable device may be employed to provide support, wherein the plurality of available configurations and the plurality of available volumes are independent of whether the inflatable device is supporting the at least the part of the body of the user at a time of configuration, and wherein the at least one shape-defining member is configured such that adjustments to the at least one shape-defining member adjust the shape and the configuration of the inflatable bladder to provide adjustments to the volume to which the inflatable bladder can be inflated at each of the plurality of available configurations relative to others of the plurality of configurations.

38. The inflatable device of claim 37, wherein the at least one shape-defining member is removably coupled to the inflatable bladder.

39. The inflatable device of claim 37, wherein the volume corresponds to an overall shape of the inflatable device.

40. The inflatable device of claim 37, wherein the at least one shape-defining member includes a first partial membrane adapted to attach to the inflatable bladder.

41. The inflatable device of claim 37, wherein the at least one shape-defining member includes a second partial membrane adapted to attach to the first partial membrane.

42. The inflatable device of claim 37, wherein the at least one shape-defining member includes a flexible shape-defining member.

43. The inflatable device as claimed in claim 37, wherein the at least one shape-defining member includes a covering layer that at least partially surrounds the inflatable bladder.

44. The inflatable device as claimed in claim 43, wherein the covering layer is attached to at least one side of the inflatable bladder.

45. The inflatable device as claimed in claim 43, wherein the covering layer is quilted.

* * * * *

UNITED STATES PATENT AND TRADEMARK OFFICE

CERTIFICATE OF CORRECTION

PATENT NO. : 8,434,177 B2
APPLICATION NO. : 11/954932
DATED : May 7, 2013
INVENTOR(S) : Robert B. Chaffee It is certified that error appears in the above-identified patent and that said Letters Patent is hereby corrected as shown below:

In the Claims

At column 16, claim number 5, line number 60, "membane" should read -- membrane --.

Signed and Sealed this
Thirteenth Day of August, 2013

Teresa Stanek Rea
*Acting Director of the United States Patent and Trademark Office*